US005590776A

United States Patent [19]

Galbierz et al.

[11] Patent Number: 5,590,776

[45] Date of Patent: Jan. 7, 1997

[54] MULTI-PACK CARRIER FOR BOTTLES

[76] Inventors: Richard T. Galbierz, 10809 Forest Path, St. Louis, Mo. 63128; Michael A. Galbierz, 5962 Pennbrooke Dr., St. Louis, Mo. 63129

[21] Appl. No.: 540,199

[22] Filed: Oct. 6, 1995

[51] Int. Cl.[6] ..... B65D 75/00

[52] U.S. Cl. ..... 206/427; 206/153; 206/155; 206/158

[58] Field of Search ..... 206/427, 429, 206/434, 145, 147, 148, 149, 152, 153, 155, 158, 161, 199

[56] References Cited

U.S. PATENT DOCUMENTS

| | | | |
|---|---|---|---|
| 2,298,209 | 10/1942 | Gray . | |
| 2,437,667 | 3/1948 | Smith . | |
| 2,654,474 | 10/1953 | Ringler | 206/158 |
| 3,038,600 | 6/1962 | Powell . | |
| 3,038,602 | 6/1962 | Rapata . | |
| 3,137,109 | 6/1964 | Rapata . | |
| 3,139,981 | 7/1964 | Akeireb . | |
| 3,156,358 | 11/1964 | Randrup . | |
| 3,175,684 | 3/1965 | Andre et al. | 206/155 X |
| 3,281,180 | 10/1966 | Spery . | |
| 3,317,234 | 5/1967 | Burford . | |
| 3,331,500 | 7/1967 | Poupitch . | |
| 3,383,827 | 5/1968 | Schaich . | |
| 3,394,800 | 7/1968 | Brackett et al. . | |
| 3,454,157 | 7/1969 | Kulig . | |
| 3,528,697 | 9/1970 | Wood . | |
| 3,601,439 | 8/1971 | Peuplich . | |
| 3,897,873 | 8/1975 | Graser . | |
| 3,926,307 | 12/1975 | Klygis . | |
| 4,064,989 | 12/1977 | Olsen . | |
| 4,109,787 | 8/1978 | Klygis et al. . | |
| 4,180,191 | 12/1979 | Wood | 206/147 X |
| 4,190,149 | 2/1980 | Oliff et al. . | |
| 4,273,273 | 6/1981 | Zenri . | |
| 4,305,500 | 12/1981 | Jaeschke | 206/153 |
| 4,318,476 | 3/1982 | Wood et al. | 206/153 X |
| 4,326,628 | 4/1982 | Wood . | |
| 4,372,598 | 2/1983 | Quelch . | |
| 4,378,878 | 4/1983 | Graser . | |

(List continued on next page.)

FOREIGN PATENT DOCUMENTS

| | | |
|---|---|---|
| 0048506 | 3/1982 | European Pat. Off. . |
| 2363493 | 3/1978 | France . |
| 7130796 | 11/1971 | Germany . |
| 2085391 | 5/1984 | United Kingdom . |

*Primary Examiner*—Paul T. Sewell
*Assistant Examiner*—Tara L. Laster
*Attorney, Agent, or Firm*—Polster, Lieder, Woodruff & Lucchesi

[57] ABSTRACT

A carrier is provided for carrying a plurality of bottles such as, but not limited to, long-necked glass bottles or PET bottles. The carrier includes a top panel and at least one side panel. The top panel has a first ply defining an array of surrounding apertures and a second ply below the first ply defining an array of container receiving apertures which are concentric with the surrounding apertures of the first ply. A plurality of slits extending radially from each container receiving aperture of the second ply to define tabs which engage a bottle's chime and hold the bottle in the carrier. The fold point for the tabs is defined by the surrounding apertures. The carrier can be formed as a box-top or sleeve carrier having a bottom panel defining openings which are concentric with the apertures in the top panel. The box-top carrier holds the bottles in tight formation and in contact with each other to prevent the bottles from impacting each other to prevent damage to the bottles. The carrier may also be provided with a release mechanism to facilitate removal of the bottles from the carrier. In one form, the release mechanism includes a release tab extending between columns of the surrounding apertures of the top panel's first ply and release openings formed between the container receiving apertures in the top panel's second ply. The release openings in the bottom panel are connected to the container receiving apertures by at least a slit. The release may alternatively include an individual pull tab for each bottle in the carrier, or a pair of tear lines which allow a corner of the carrier to be removed.

43 Claims, 14 Drawing Sheets

U.S. PATENT DOCUMENTS

| | | | |
|---|---|---|---|
| 4,378,879 | 4/1983 | Killy | 206/158 |
| 4,401,212 | 8/1983 | Fischer . | |
| 4,432,579 | 2/1984 | Denmark et al. . | |
| 4,453,630 | 6/1984 | Helms et al. . | |
| 4,621,734 | 11/1986 | Heijnen et al. . | |
| 4,736,977 | 4/1988 | Killy . | |
| 4,850,478 | 7/1989 | Kidd | 206/147 |
| 4,925,020 | 5/1990 | Gordon . | |
| 4,936,455 | 6/1990 | Bienaimé . | |
| 5,020,661 | 6/1991 | Marco . | |
| 5,058,735 | 10/1991 | Bienaimé . | |
| 5,125,506 | 6/1992 | Galbierz et al. | 206/151 |
| 5,139,137 | 8/1992 | Marco . | |
| 5,186,321 | 2/1993 | Fadus . | |
| 5,323,895 | 6/1994 | Sutherland et al. | 206/147 |
| 5,328,024 | 7/1994 | Sutherland | 206/158 |
| 5,351,815 | 10/1994 | Fogle et al. | 206/153 |
| 5,445,262 | 8/1995 | Sutherland | 206/148 |
| 5,476,170 | 12/1995 | Weber | 206/147 |
| 5,485,914 | 1/1996 | Martin | 206/145 |
| 5,487,463 | 1/1996 | Harris | 206/145 |
| 5,487,464 | 1/1996 | Galbierz et al. | 206/149 |

MULTI-PACK CARRIER FOR BOTTLES

FIELD OF THE INVENTION

This invention relates to multi-pack carriers for bottles, and in particular a multi-pack carrier which is simple to manufacture and easy to assemble, which will securely hold bottles therein, and which will allow for easy release of the bottles from the carrier.

BACKGROUND OF THE APPLICATION

Multi-pack carriers have long been available to facilitate the carrying of bottles or the like. Thus, customers can buy bottles of beverages in 6-packs or the like. Many of these carriers, however, lack total consideration of the economics of high speed manufacture, bulk shipment in a flat state, ease and speed of assembly of the carrier, as well as ease of container release and removal by the consumer. Other carriers available, while suitable for their intended purpose, are complicated in construction, in their assembly, and do not facilitate removal of containers from the carrier by the consumer.

The most common multi-pack carrier for bottles is the basket carrier, which, as the name denotes, is formed into a basket which receives the bottles. Six-packs of soda or beer are often seen in such basket carriers. Basket carriers, however, are formed from complex blanks which produce a significant amount of waste. The assembly of basket carriers and the filling of bottles used in basket carriers is difficult, time consuming, and expensive. Because the blanks for basket carriers are complex, they require complex machinery to assemble the baskets. Typically, the basket carriers are formed and placed into a case and filled with bottles. The bottles in the basket are then transported to the filling plant. At the filling plant, the bottles are removed from the basket, washed, and then placed on the filling line. Once the bottles are filled and capped, crowned, or otherwise closed, they are placed back in the carrier. Basket carriers also create difficulties in the store. They are difficult to stack, and when they are, the basket can catch the crown of a bottle in a basket adjacent the selected basket. This can cause the adjacent bottles to fall, resulting in breakage and loss of product, as well as associated revenue for the store.

To overcome the problems associated with basket carriers, many different carriers have been provided which are in the form of flat or planar carriers which accept the bottles or in the form of sleeves through which the bottles extend. These carriers typically have openings through which the neck of the bottle extends. The openings are surrounded by tabs which in many instances catch the bottom of the bottle crown to hold the bottle in the carrier. Others provide tabs which catch the bottom of the bottle's chime. To remove the bottles from the carriers, the bottles must be pulled downwardly through the tabs. As can be appreciated, in the first instance, the crown, which is crimped when secured to the bottle, will catch the tabs making the bottle difficult to remove. In the second instance, the chime will have to be pulled through the upwardly extending tabs. In either case, the upward force exerted by the tabs against the cap or chime of the bottle must be overcome to remove the bottle from the carrier. If the carrier is to be strong enough to carry six bottles, this force can be difficult to overcome.

Presently available carriers are scored or embossed to provide a hinge point for the tabs. When the carrier is scored or embossed to form the tabs, the fibers, which provide strength to the carrier, are broken, leading to a loss of strength of the carrier. Further, the scoring of the paperboard enables the paperboard carrier to more easily absorb moisture. As can be appreciated, the absorption of moisture will weaken the carrier.

To overcome the difficulty of removing the bottles from the carriers, the carriers should be provided with a release mechanism. Examples of carriers which provide release mechanisms for the bottles are shown in U.S. Pat. Nos. 3,926,306 to Klygis and 4,401,212 to Fischer. In the first patent, the carrier is in the form of a sleeve and is provided with a pull-tab which extends along a side panel of the carrier. The pull tab enlarges the opening so that the bottles can be removed therefrom. However, because a single pull tab is provided and because the pull tab enlarges the openings through which the bottle necks extend, removal of the tab can weaken the carrier and allow the bottles to accidentally escape from the carrier. The second patent provides for a key-slot style aperture through which the bottle neck extends. To remove the bottle from the carrier, the bottle is moved relative to the key slot to be aligned with a larger diameter area of the key slot. This larger diameter area has a diameter larger than the chime or take-out bead of the bottle and the bottle may be removed from the carrier. However, the bottle may accidentally come into alignment with the larger diameter area and become loose in the carrier. Another release mechanism is shown in a co-pending application, Ser. No. 282,778, filed Jul. 29, 1994, which is incorporated herein by reference. The release mechanism shown therein provides independent pull tabs for each bottle in a flat or planar carrier.

Bottles are relatively long and have narrow diameters when compared to beverage cans. Thus, when the bottle is held by its neck, the bottle may form a pendulum with respect to the carrier and be able to swing when held by the carrier. If the bottles are allowed to swing too much, they can contact each other and break. Regulatory and practical requirements dictate against a construction which will allow the bottle to swing in the carrier.

SUMMARY OF THE INVENTION

One object of the present invention is to provide a multi-pack carrier for securely carrying a plurality of bottles.

Another object is to provide such a carrier wherein the carrier is not weakened by score lines near the bottle.

Another object is to provide the carrier with a release so that the bottles can be easily removed from the carrier.

Another object is to provide such a carrier release which will not weaken the carrier or allow remaining bottles to become loose in the carrier.

Another object is to provide such a carrier which will minimize or substantially prevent the bottles from impacting each other when they are carried in the carrier.

Another object is to provide such a carrier which maximizes the planar strength of the carrier, in part by using a two-ply panel, to minimize bottle impacts.

Another object is to provide a message space on the carrier for display of advertisement, UPC codes, etc. without interfering with the release of bottles from the carrier.

Another object is to provide such a carrier which may be produced at high speed and shipped in bulk in a flat state.

Another object is to provide such a carrier which may be reused to facilitate recycling of bottles.

Another object is to provide such a carrier which is recyclable or made from recycled materials.

These and other objects will become apparent to those skilled in the art in light of the following disclosure and accompanying drawings.

In accordance with the invention, generally stated, a carrier is provided for carrying a plurality of bottles such as long-necked glass bottles or PET bottles in an array of two columns. As is common, such bottles have a body, a neck extending upwardly from the body, a mouth at the top of the neck, a closure closing the mouth, and a flange below the mouth. The flange has a lower surface which defines a chime at a point where the flange's lower surface intersects the neck of the bottle. The carrier includes a top panel and at least one side panel. The top panel has a first ply defining an array of surrounding apertures and a second ply below the first ply defining an array of container receiving apertures which are concentric with the surrounding apertures of the first ply. A plurality of slits extending radially from each container receiving aperture of the second ply to define bottle engaging tabs. The container receiving apertures have a diameter slightly less than the diameter of the chime, such that the tabs will be pushed or forced upwardly when the carrier is applied to a group of bottles. The surrounding apertures of the top ply having a diameter substantially equal to the diameter of a circle defined by outer ends of the tabs to define fold points for the tabs. There are no scores, slits, embossments, etc. at the base of the tabs to define the fold lines for the tabs. Thus, the fold lines for the tabs are defined solely by the surrounding apertures. The tabs have a length such that they engage the bottle chime, and form an angle of between about 50° and about 70°, and preferably about 60°, with the top panel of the carrier.

The carrier can be formed as a panel carrier, wherein the carrier includes the top panel and one or more side panels which depend from the top panel. The carrier can also be formed as a box-top or sleeve carrier, wherein the carrier includes the top panel, two side panels and a bottom panel. In the box-top carrier, the bottom panel defines openings which are concentric with the apertures in the top panel. The carrier formed from a one-piece, integral blank which defines, in the first instance, at least the panel(s) of the carrier and the top ply of the top panel. In the case of the box-top carrier, the one-piece blank defines at least the bottom panel, side panels, and the top ply of the top panel. The second ply of the top panel may also be formed integrally with the blank.

The carrier may be provided with a handle. The handle may be positioned at the center of the carrier, between the two rows of apertures, or it may be positioned at the edge of the carrier. If the handle is formed along the edge of the carrier, two carriers can be secured together to form a dual pack (i.e., an 8- or 12-pack, or the like). The package so formed is balanced around the handle. The handles may be one ply or two ply handles. The handles include an opening through which a customer's hand will fit so that the carrier may be lifted by the handle. The handle may be provided with a flap which folds through the hand opening so that a sharp edge of the handle will not bite into the customer's hand.

When the carrier is formed as a box top carrier, the bottom panel has continuous, uninterrupted edges extending from the side panels. That is, the bottom panel is formed from only one piece, rather than having two halves which are somehow connected, such as in Kidd, U.S. Pat. No. 4,850,478. The openings in the bottom have a diameter slightly smaller than the neck of the bottle along a plane where the bottom panel intersects the neck. The openings in the bottom panel, and hence the apertures in the top panel, are arranged in the carrier such that the bottle bodies are in firm contact with each other when the bottles are placed in the carrier. Further, a portion of the edge of the openings in the bottom panel frictionally engages a surface of the bottles to grip the bottles. The side panels, when in compression, have a height which will force the bottom panel in tension between the side panels and create a frictional contact between the edge of the openings of the bottom panel with the bottles. The frictional grip or contact of the bottom panel on the bottles, and the grouping of the bottles by the carrier will substantially prevent impacts between the bottles when the carrier is moved during handling or transportation to substantially prevent damage of the bottles.

The openings in the bottom panel may be circular, there being one opening per bottle. This will define a paperboard area between the two columns of bottles which will positively separate the necks of the bottles. The openings in the bottom panel may also be elongate oval openings which have semi-circular ends. In this instance, each opening encompassing the two bottles in a row of the carrier.

The carrier may also be provided with a release mechanism to facilitate removal of the bottles from the carrier. The release mechanism includes a release tab extending between the two columns of the surrounding apertures of the first ply of the carrier's top panel and release openings formed between the container receiving apertures in the second ply of the top panel. The release tab includes a tab leader and a tab body. The tab leader extends from an edge of the first ply to a point adjacent the first row of surrounding apertures. The tab body has a width equal to or greater than the width between the surrounding apertures, such that the release tab defines at least a portion of the surrounding aperture, such that at least one surrounding aperture is opened when the release tab is removed from the top ply of the carrier's top panel. When the release tab is removed, it exposes the release openings in the second ply and the bottle may be "walked" out of the carrier without the need to pull the bottle vertically through the bottle retaining tabs. The release openings may be formed as slits which penetrate the second ply and extend between two adjacent container receiving apertures which form a row in the second ply. The release openings may alternatively be a cut-out between the two container receiving apertures of a row and slits extending from the release cut-out to an edge of the container receiving apertures. The release cut-out can be elliptical (i.e. circular or oval) or formed as an elongate opening.

The release mechanism may alternatively be an individual release tab for each bottle which may be inserted in the carrier. Each release tab has a tear strip extending between an aperture of the top panel (either the surrounding aperture or the container receiving aperture), along the side panel, to the associated opening on the bottom panel. A finger grip is operatively connected to the tear strip, which when pulled, will remove the tear strip from the carrier. When this release mechanism is operated, the surrounding aperture, the container receiving aperture, the bottom panel opening for a specific bottle are all opened. Further, an opening along a side of the carrier is formed when the release tab is pulled. The finger grip may be formed in either the first ply or the second ply of the top panel. The tear strip preferably has a shape corresponding substantially to the shape of the bottle neck.

In another embodiment, the release mechanism includes at least a perforated line in the first and second plies of the top panel which, when separated, allow for a bottle to be extracted from the carrier through a corner of the carrier. The release mechanism preferably includes two perforated lines extending from each surrounding aperture in the first ply and a perforated line and a slit extending from each container receiving aperture in the second ply. The perforated lines of the first ply are at an angle to each other and extend from the surrounding aperture to adjacent edges of the carrier. The perforated line and slit of the second ply are aligned with the perforated lines of the first ply. When a corner area of the container is pushed or pulled, the corner will hinge or tear away from the container to open the apertures of the top panel.

DESCRIPTION OF THE PREFERRED EMBODIMENT

Figure 1:
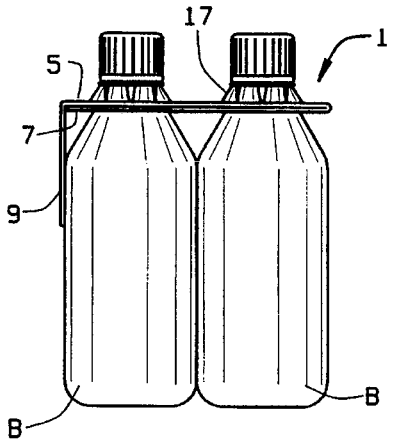
FIG. 1 is a side elevational view of a first embodiment of a carrier of the present invention, the carrier having a single side panel and having PET bottles therein.
Figure 2:
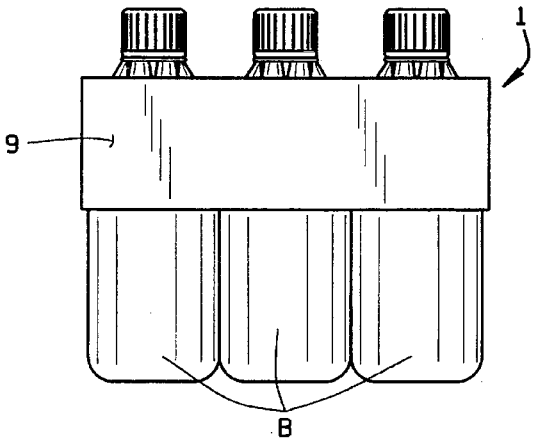
FIG. 2 is a front elevational view of the carriers of FIGS. 1 and 8B.

A first embodiment of a multi-pack carrier 1 of the present invention is shown in FIGS. 1 and 2 with bottles B placed in the carrier. The carrier 1 is preferably made of paperboard so that the carrier may be recycled after use. The carrier may be made from virgin or recycled paperboard, or a combination of virgin and recycled paperboard. Preferably, the paperboard is solid unbleached sulfate (SUS) kraft board, rather than corrugated cardboard, such as is used in Kidd, U.S. Pat. No. 4,850,478. As the need arises, a higher paperboard strength, stiffness, and rigidity can be obtained by increasing the paperboard density, by using paperboard made according to the Fordranier process, or by using a paperboard in which the plies of the paperboard are laminated together, such that the machine direction of the plies are offset from each other by, for example, 90°. The paperboard for the carrier should also be formulated to provide a high wet strength. Brown, as-produced, paperboard can be used for the carrier. However, the paperboard is preferably made white, either by bleaching or clay coating the kraft paperboard, to enable the use of quality graphics and to produce an aesthetically pleasing carrier. Although not preferred, the carrier could be made from other materials, such as plastic, without departing from the inventive concept.

As is conventional, the bottles B each have a neck N (FIGS. 4 and 14), a flange (in PET bottles) or a take-out bead (in glass bottles, see FIG. 14) F at the top of the neck N and below the mouth of the bottle. The flange or take-out bead forms a chime C with the neck of the bottle where the bottom of the flange or take-out bead intersects with the neck.

Figure 3:
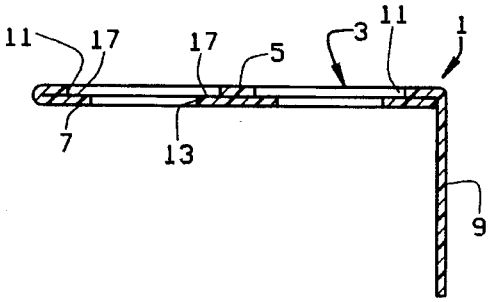
FIG. 3 is a cross-sectional view of the carrier of FIG. 1.

The carrier 1 is a planar carrier and which has a two-ply top 3 seen best in FIG. 3 which has a top-ply 5 and a bottom or reinforcing ply 7. The two plies are needed for the positive retention of the containers, as well as to provide increased planar strength and rigidity for shipping and handling of the beverage package. A side panel 9 depends from one of the plies of the top 3. The side panel 9 adds structural rigidity to the carrier 1 and prevents bending of the carrier in the plane of the top panel. Thus, when the bottles B are placed in the carrier, the carrier will resist bending and will remain substantially planar. The side panel also provides a place for advertising material or product name information to be primed on the carrier so as to be readily visible to consumers in the store. The panel further provides a place to position the UPC code for the product. In product where there is a special price for multi-pack carriers (as opposed to purchasing bottles individually) placement of the UPC code on the panel will provide for easy scanning of the UPC code of the multi-pack. The panel will also serve to hide any UPC code which may exist on the bottle to prevent accidental scanning of the UPC code on the bottle.

Figure 4:
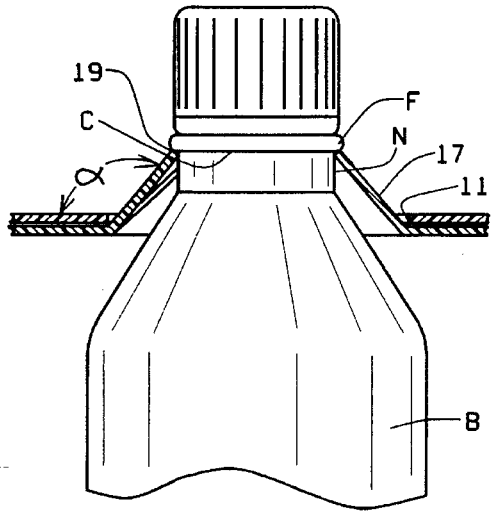
FIG. 4 is a cross-sectional view of the carrier having a bottle, showing how the carrier engages the bottle to hold the bottle in place.
Figure 5:
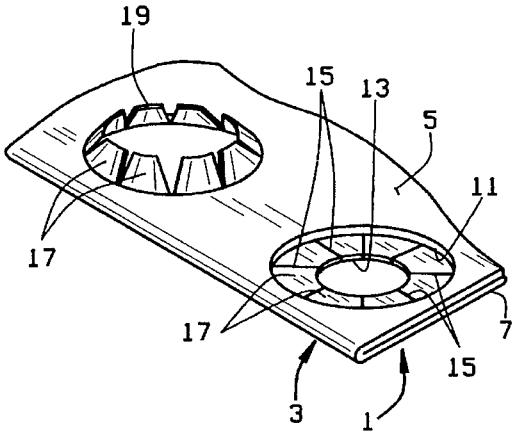
FIG. 5 is an enlarged, fragmentary perspective view of the carrier of FIG. 1, showing one bottle receiving opening in a closed state, and another in an opened state.
Figure 6:
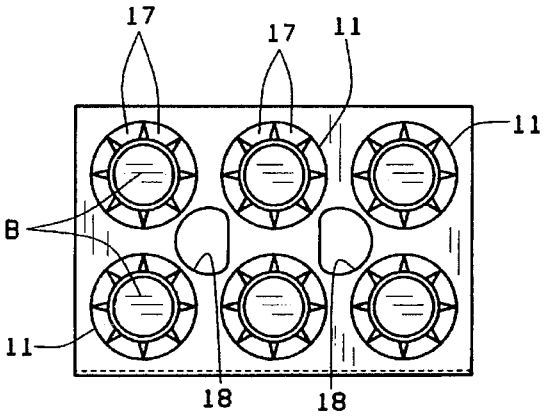
FIG. 6 is a top plan view of the carrier when bottles are placed in the carrier.

As best seen in FIG. 5, the top ply 5 of the carrier defines a plurality of surrounding apertures 11 which are evenly spaced about the top ply. Typically four or six apertures are formed in the top panel in a 2×2 or 2×3 array, as seen in FIG. 6. Other aperture configurations with any desired number of apertures could of course be used. The reinforcing ply 7 defines a plurality of container receiving apertures 13 which have a diameter slightly smaller than the diameter of the bottle's neck N m a point below the bottle's flange F (FIG. 4). A plurality of slits 15 radiate outwardly from the container receiving apertures 13 to define fingers or tabs 17. The container receiving apertures 13 are positioned to be concentric with the surrounding apertures 11 in the top ply 5. The surrounding apertures 11 have a diameter sized to be substantially equal to the diameter of a circle defined by the radially outermost end of the slits 15. The edge of the surrounding aperture 11 defines a folding point for the tabs 17, as best seen in FIG. 4 and the scoring or embossing of the ply to define the fold line is not necessary. The elimination of this fold line in our carrier maintains the structural integrity of the carrier and its tabs and reduces the carrier's susceptibility or vulnerability to weakening by the absorption of moisture. The carrier 1 is also provided with finger holes 18 (FIG. 6) so that a consumer can easily pick up and carry the multi-pack carrier. As is common, finger holes 18 are preferably D-shaped.

When the bottles are placed in the carrier, the tabs 17 engage the chime C of the bottle, as seen in FIG. 4. The tabs 17 are of a length, such that they form an angle $\alpha$ of about 60° with the top ply when the bottle is in the carrier and the tip 19 of the tab is engaged with the bottle's chime C. If the angle $\alpha$ is much greater than 60°, the tabs will be too vertical and it will be difficult to remove the bottle B from the carrier 1. If the angle $\alpha$ is much less than 60°, the tabs 17 will be too horizontal and will tend to collapse, not having enough vertical strength to hold the bottles B in the carrier. The use of SUS board for the carrier yields greater strength and rigidity for the tabs 17 without the need to consider cross- or machine-direction weaknesses.

The number of slits 15 (FIG. 5) formed in the carrier depends on the diameter of the container receiving apertures 13 to prevent the tabs from being too narrow or broad. If the tabs are too broad, there will be insufficient contact of the tip 19 or radially innermost edge of the tab 17 with the bottle chime C and the bottle will not be adequately supported in the carrier. We have found that a tab with a side-to-side width of about 0.25" to 0.35" at the tip 19 of the tab (i.e. at the radially innermost edge of the tab) works well. To maintain this dimension, we have found that it is preferable to provide eight tabs when the container receiving aperture 13 has a diameter of 0.625" to 0.875"; for diameters between 0.875" and 1.375", there are preferably twelve (12) tabs; and; for diameters between 1.375" and 1.875", there are preferably sixteen (16) tabs. As the diameter of the container receiving apertures 13 become greater than 1.875", the number of tabs 17 will have to be properly increased. As noted above, the tabs are sufficiently long to form an angle of about 60° with the carrier top 3 when the tab engages the chime C of the bottle. This preferred tab size (i.e. length and width) provides for a tab which will clear the diameter of the bead or flange F when the bottle is passed through the aperture, yet will allow the tab to be resilient, such that the tab will spring back to engage the chime C of the bead or flange F of the bottle.

As noted above, the tabs engage the chime C rather than the cap or crown of the bottle B. When the crown of a glass bottle is engaged by the tab, the container seal formed by the crown with the bottle may be impaired. The integrity of this seal or closure is not affected when the tab engages the chime. Although it is preferred that the tabs engage the chime C of the bottle, when PET bottles with screw on caps are being placed in the carrier, the tabs may engage the bottom of the bottle cap. Because the caps are screw on caps, the engagement of the tab with the cap will not impair the container seal.

Figure 7:
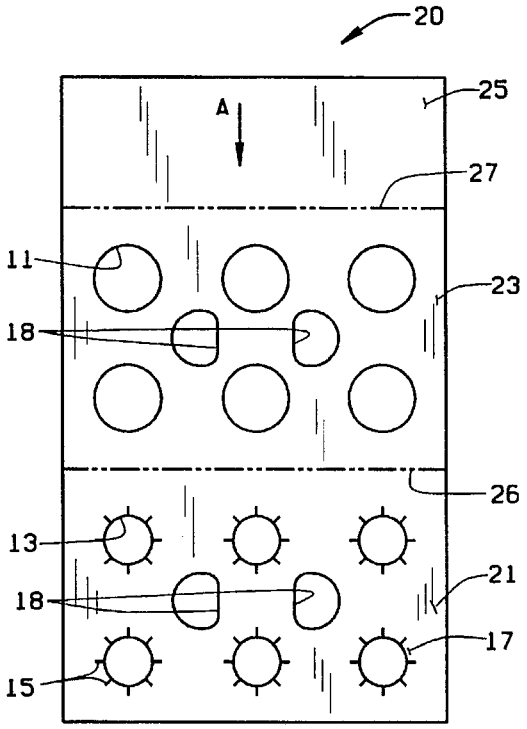
FIG. 7 is a plan view of a carrier blank used to form the carrier of FIG. 1.

A carrier blank 20 used to form the carrier 1 (FIG. 1) is shown in FIG. 7. The blank 20 is formed as an integral, one-piece, unitary blank. It has an end section 21 which forms the reinforcing ply 7, a middle section 23 which forms the top layer 5, and a second end section 25 which forms the side flap 9. The sections are divided or separated by fold lines 26 and 27. The fold lines are formed by embossing or scoring the paperboard. The blank is preferably die cut in a single operation. The die is configured to cut the apertures 11 and 13, the scores or slits 15, as well as finger holes 18. The blank 20 is formed into a carrier by folding the sections 21 and 23 along fold line 26 and gluing or bonding the two sections together. Section 25 is folded along the fold line 27 to form the side flap 9 of the carrier 1. The formation of the carrier from the blank may be done by hand, but is preferably automated with folding equipment which is known in the art and forms no part of this invention. As noted above, the fold lines 26 and 27 of the blank are formed by scoring or embossing the paperboard. Scoring weakens the paperboard and the joint between the two panels. Further, by not scoring the paperboard to define the fold lines, the paperboard is not restricted to machine orientation when stamped into the blank.

In use, the bottles B are gathered together (typically in a six-pack or four-pack formation) and the carrier is placed over the tops of the bottles and pressed down over the bottles' closures, causing the tabs 17 to bend upwardly where the slits 15 meet the aperture 11 of the top ply 5, as shown in FIGS. 4 and 5. The aperture 11 thus defines the hinge point for the tabs 17 without the need to score or emboss hinge lines in the ply 7. The carrier is pressed down over the bottles until the tabs clear the take-out bead or flange F of the bottle. This process may be performed manually or by machinery known in the art which will accept the carriers and press them over the bottles. This machinery does not form a part of the invention. The design of the carrier requires little force to secure the bottles-in the carrier.

The use of two-plies (FIG. 3) adds planar strength to the carrier. This planar strength is reinforced by the side panel 9. Thus, when the carrier is filled, and being carried, the top 3 of the carrier 1 will remain substantially planar. As can be seen in FIGS. 1 and 2, the apertures are positioned such that the bottles' bodies contact each other. The use of two plies also enables the carrier to define fold or hinge lines for the tabs 17 without the use of score lines. The tabs are formed in the bottom ply and are preferably not formed in the top ply. If the tabs were formed in the top layer, the top 3 of the carrier could tear beyond the desired length of the tabs. The carrier would be weakened and may be incapable of carrying the beverage containers.

Figure 8B:
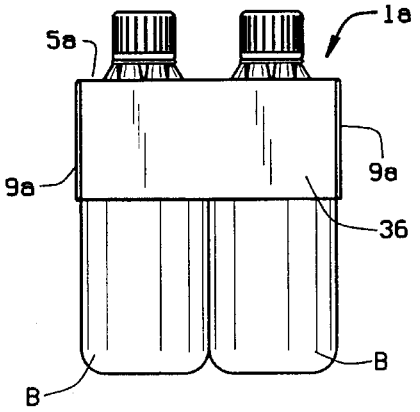
FIG. 8B is a side elevational view of the carrier blank of FIG. 8 folded to form a carrier, and the carrier having PET bottles contained therein.
Figure 8C:
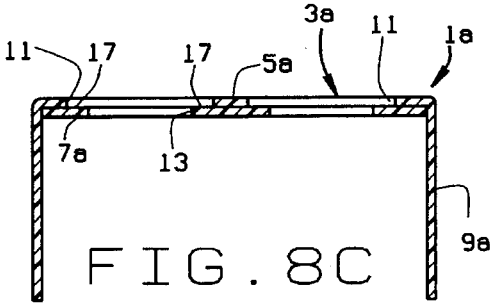
FIG. 8C is a cross-sectional view of the carrier of FIG. 8A, but with the side panels folded relative to the top panel.
Figure 8:
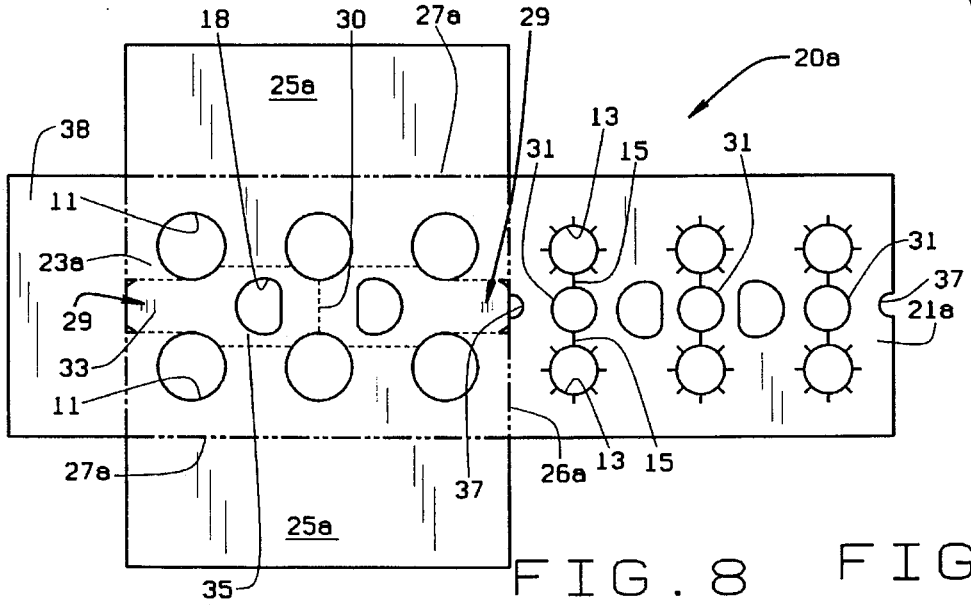
FIG. 8 is a plan view of a second embodiment of a blank for forming a carrier similar to that of FIG. 1, but having two side panel forming sections, a front panel forming section, and a release mechanism.
Figure 8A:
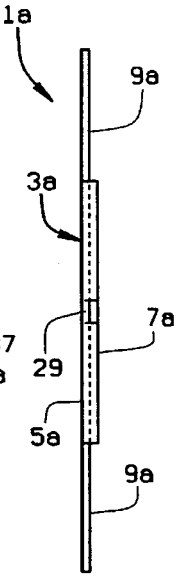
FIG. 8A is a side view of the carrier formed from the carrier blank of FIG. 8 folded and in a flat state to be shipped in bulk.

A second embodiment of the carrier 1*a* and its blank 20*a* are shown in FIGS. 8–8C. Blank 20*a* provides for a carrier having two side panels 9*a*. As can be seen, the sections 21*a* and 23*a* of the carrier are joined by a hinge line 26*a* along their short edges, and the side flap portions 25*a* are hingedly joined along the longer edges of the top ply forming portion 23*a* by fold lines 27*a*. This allows for the side flaps to remain along the long edges, as is the case with the blank 20, such that the length of the flap will be maximized to provide the greatest reinforcement possible to the carrier. The carrier 1*a* is shown flat in FIG. 8A with the panels or flaps 9*a* in the same pirate as the carrier top 3*a*. As can be seen, the carrier can be substantially flat, and thus can be shipped in bulk easily. The carrier 1*a* is shipped flat, as shown if FIG. 8A, and at the packaging site, the carrier panels 9*a* are folded under the top panel 3*a* to place the carrier in the form shown in FIG. 8C. When the panels 9*a* are folded under the top panel, they spring back, when released, to be substantially perpendicular to the top panel. The bottles B are then placed in the carrier to form a package, as shown in FIG. 8B.

The carrier 1*a* of FIG. 8B is shown to include a front panel 36 which is formed by a portion 38 (FIG. 8) of the carrier blank 20*a*. Portion 38 is hingedly connected to the top panel forming portion 23*a* along an edge opposite of the bottom panel forming section 21*a*. The front panel 36 will, when the carrier 1*a* is formed, depend from the top ply 5*a* of carrier la and extend substantially between the side panels 9*a*. The panel 36 is foraged along the shorter edge of the carrier 1*a*. When the carrier package is placed in a store, it is this side that is often seen by consumers. Thus, the panel 36 allows for the placement of graphics along a portion of the panel that will be seen by consumers.

Figure 29:
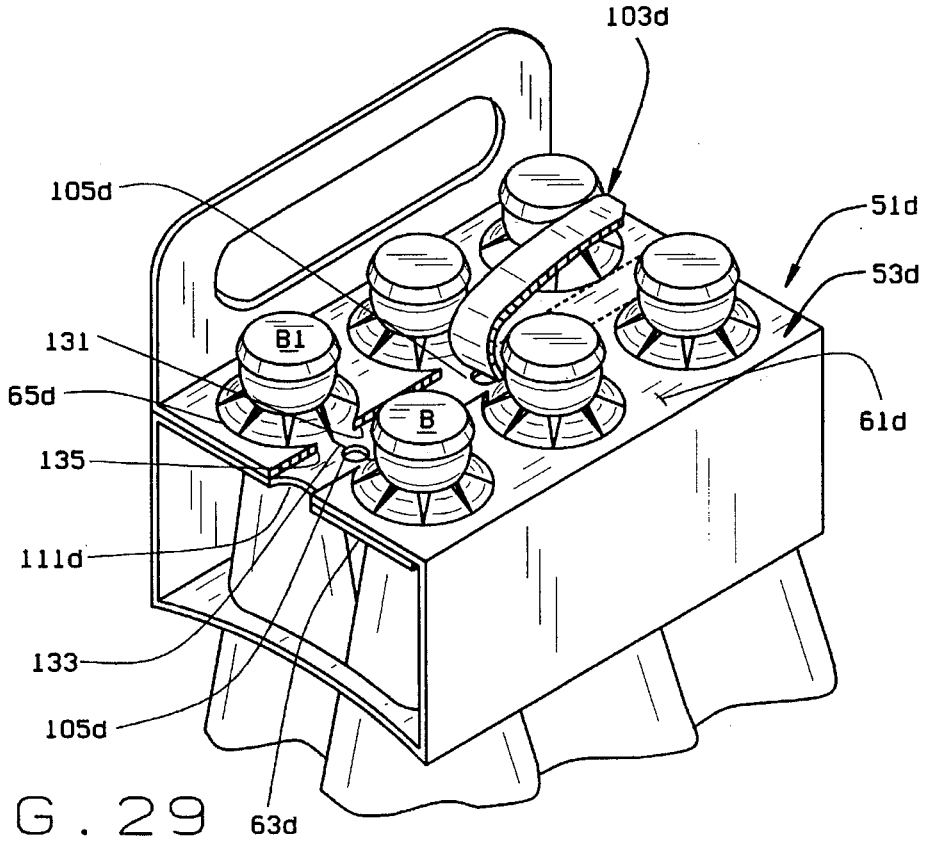
FIG. 29 is a perspective view of the carrier of FIG. 26 with bottles therein and showing a tab being pulled to allow for easy release of a desired bottle.
Figure 30:
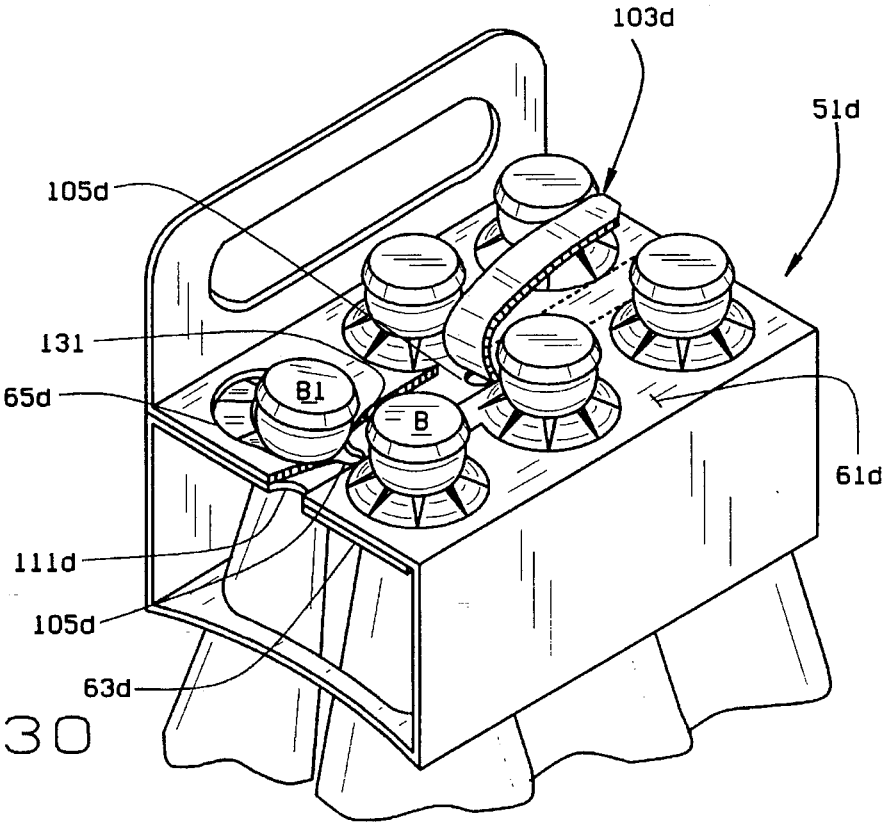
FIG. 30 is a perspective view showing a bottle being removed from the carrier in FIG. 29.

The bottles can be released from the carrier 1 by pressing or pulling straight down on the bottles. If the consumer tries to rotate the bottle out of the carrier 1, the carrier will resist this, making removal difficult. The carrier is thus provided with a release tab 29 (FIG. 8) in the top ply forming portion 23*a* and release holes 31 in the bottom ply forming portion 21*a*. In the case of a six-pack carrier, such as shown in FIG. 8, the release preferably includes two tabs 29, each of which extends from an edge of the carrier to the middle of the carrier and are separated by a perforated line 30. The apertures in the carrier top panel 3*a* form two rows of three apertures each. The tabs 29 extend between the two rows of apertures, and the release openings 31 are formed in the space between the container receiving openings 13 and are of a diameter such that the edge of the release openings reach to the slits 15. The carrier la includes finger holes 18. The release tabs 29 thus include tab leader 33 which extends from the edge of the carrier to the first pair of apertures 11 and are of a width such that the edge of the tab forms a tangent with the aperture 11. In order to fit around the finger hole 18, the tab 29 includes a body portion 35 which surrounds the finger hole 18 and extends between the outer pair of apertures 11 to the middle pair of apertures 11. The tabs are defined by perforated lines which allow for easy removal of the tab from the top ply 3*a* of the carrier. When the tab is pulled back, as shown in FIGS. 29 and 30 in association with a box-top carrier, the release openings 31 (FIG. 8) are exposed. The bottle may thus be rotated out of the carrier. By rotating the bottle, the bottle neck and cap will pass through the slit 15 into the release opening 31, effectively forming one elongate opening. The bottle may then be easily withdrawn through this enlarged opening. In order to facilitate gripping of the tabs 29, the bottom ply 7*a* is provided with a cutout 37 beneath the tab leaders 33.

Figure 9:
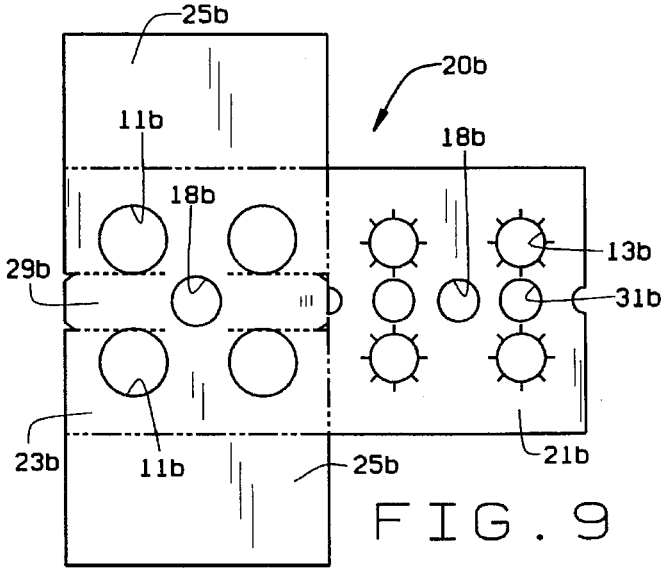
FIG. 9 is a plan view of a third embodiment of the carrier blank similar to that of FIG. 8, but for a 4-pack, and having a release mechanism.
Figure 20:
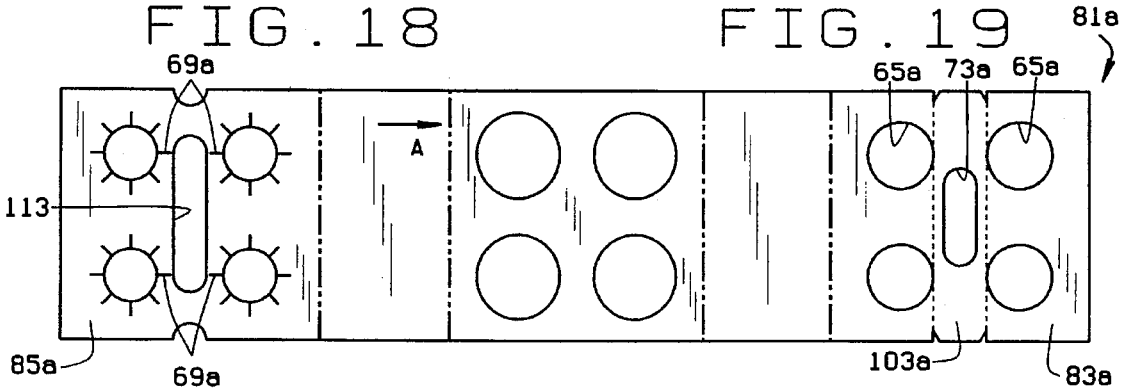
FIG. 20 is a plan view of a third embodiment of the carrier blank, similar to the blank of FIG. 16, but used to form a 4-pack, rather than a 6-pack.

A carrier blank 20*b* for a four-pack carrier is shown in FIG. 9. Blank 20*b* is similar to blank 20*a* (FIG. 8), and includes a section 21*b* which forms the second ply of the carrier's top panel, a section 23*b* which forms the top ply of the carrier's top panel, and two sections 25*b* which form side panels. Instead of having two D-holes, the blank 20*b* is provided with a single finger hole 18*b* or slit opening (such as shown in FIG. 20) in the sections 21*b* and 23*b* to provide a means by which a consumer can lift the carrier formed from the blank. The carrier blank 20*b* (FIG. 9) is provided with a release tab 29*b* formed in section 23*b* of the blank. Because the finger holes 18*b* are not larger in diameter than the width between the surrounding apertures 11*b* of the section 23*b*, the tab 29*b* can be formed as a straight tab having a width equal to the distance between the two rows of surrounding apertures 11*b*. The edges of the tab 29*b* thus form tangents with the surrounding apertures 11*b* and effectively open the surrounding aperture 11*b* and the container receiving aperture 13*b* when pulled back, much in the same manner that the apertures 11 and 13 in carrier 1*a* are opened when the tab 29 is pulled. This is shown in FIGS. 29 and 30. The only difference is that with the tab 29 of carrier 1*a*, the tab 29 forms a larger portion of the aperture 11 than does tab 29*b* in aperture 11*b*. The fact that the tab 29*b* is tangential to the apertures 11*b*, rather than forming a larger part of the edge of the aperture does not affect the performance of the release function of the tab.

Figure 10:
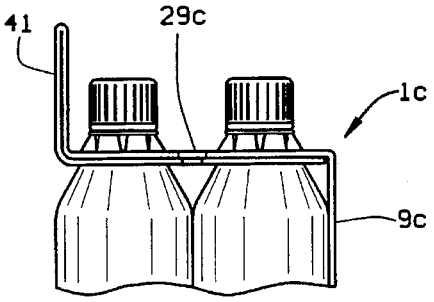
FIG. 10 is a side elevational view of a third embodiment of the carrier having PET bottles therein, the carrier being provided with a handle.
Figure 11:
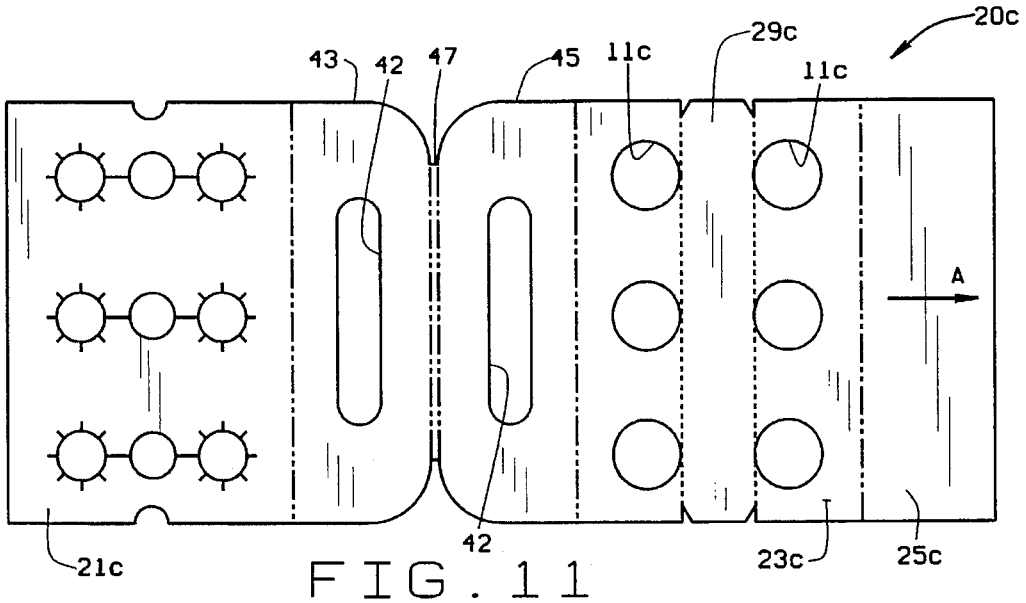
FIG. 11 is a plan view of a carrier blank used to form a carrier of FIG. 10.
Figure 12:
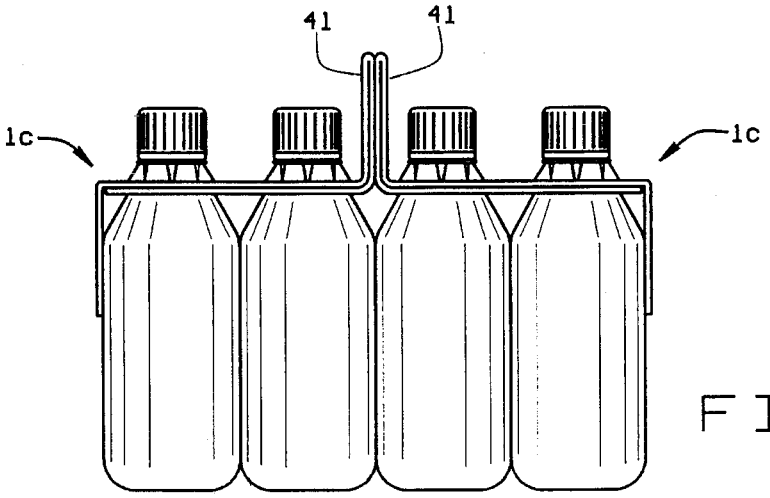
FIG. 12 is a side elevational view of a pair of the carriers of FIG. 10 secured together to form a dual-pack with a center handle.

A fourth carrier 1*c* is shown in FIG. 10. The carrier 1*c*, as can be seen, is provided with a two-ply handle 41 along an edge opposite the side flap 9*c*. The handle 41 is provided with an opening 42 (FIG. 11) sized to accommodate a consumer's hand. A carrier blank 20*c* used to form carrier 1*c* is shown in FIG. 11. The blank 20*c* includes two handle forming portions 43 and 45 which are connected by a hinge 47. The handle forming portions 43 and 45 are mirror images of each other, the hinge being formed at the top of the handle portions, so that the handle will be a two-ply handle. Portion 21*c* is hingedly connected to handle portion 43; portion 23*c* is hingedly connected to handle forming portion 45; and side flap portion 25*c* is hingedly connected to portion 23*c* along an edge opposite the handle forming portion 45. Carrier 1*c* is provided with a release tab 29*c* which extends between the two rows of surrounding apertures 11*c* in the top ply. Carrier 1*c* is provided with the handle 41, and thus does not need the D-holes to form finger holes. The tab 29*c* can be identical to the tab 29*b* shown in FIG. 9.

in FIG. 12, two carriers 1*c* are shown connected together at their handles 41 to form a dual-pack having a center handle. Because the dual-pack will be symmetrical about the handles 41, the carrier, when filled with bottles, will remain substantially balanced. The two carriers 1*c* will lie flat when joined. Thus, the two carriers 1*c* can be glued or bonded together prior to shipping and still be shipped in bulk in a flat state. The carriers may also be joined at the packaging site.

The above-described carriers are flap top carriers. Carrier blanks 20 (FIG. 7) and 20*c* (FIG. 11) are quadrilateral. This provides for a blank which can be formed with no waste, other than the waste formed by producing the apertures. The carrier blanks 20 and 20*c* can be formed without wasting any of the paperboard from which they are formed. Carrier blanks 20*a* (FIG. 8) and 20*b* (FIG. 9) have the side flap portions 25*a,b* extending outwardly from portions 23*a,b* to form the side panels. These blanks, however, are simple in shape. The blanks provided form an exact width of the paperboard and can be arranged to minimize waste.

As can be appreciated, the carriers of FIGS. 1–12 can be shipped flat, making bulk shipment of the carriers economically easier. That is, unlike basket carriers, when these carriers are shipped, they are shipped flat, and there is virtually no "air" that is shipped. To ship the carriers, the side panels remain in the same plane as the top panel. At the packaging site, the side panels are folded under the top panel so that, when released, the side panels will be nearly perpendicular to the top panel when the carrier is applied to a group of bottles. If desired, the side panels may be folded under the top panel to ship the carrier. In either instance, the carrier, in its shipping state, is flat and quite thin. Thus, the carrier can be easily shipped in bulk to a packaging site, where the carrier will be applied to bottles, as described above.

Figure 13:
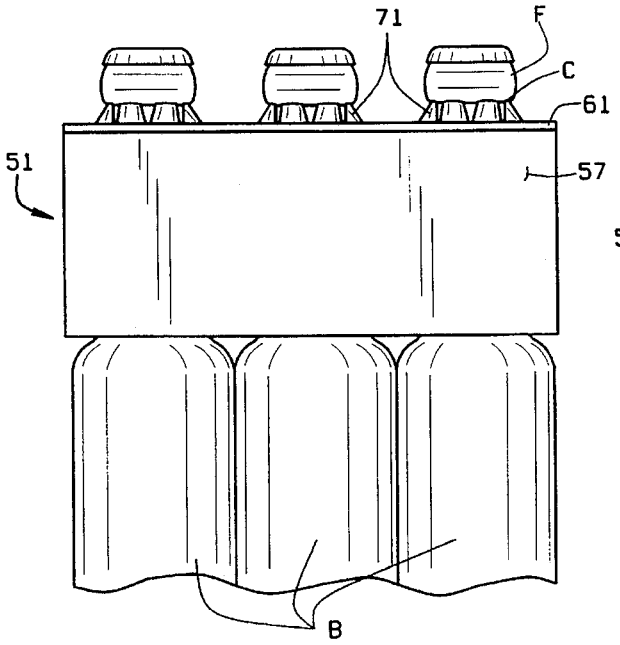
FIG. 13 is a front elevational view of a box-top carrier having long-neck glass bottles therein.
Figure 14:
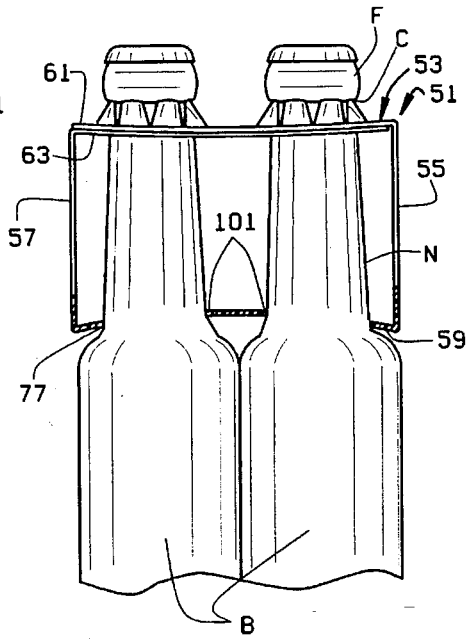
FIG. 14 is a side elevational view of the box-top carrier, partly in cross-section having long neck bottles therein.
Figure 15:
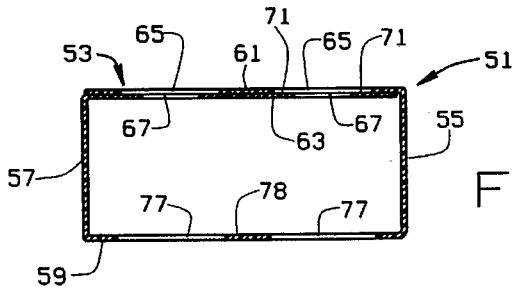
FIG. 15 is a cross-sectional view of the formed box-top carrier.

A box-top carrier 51 is shown in FIGS. 13–15. The carrier 51 includes a two-ply top panel 53, side panels 55 and 57, and a bottom panel 59. The top panel 53 is a two-ply top panel and has an outer or top ply 61 and a bottom ply 63. Together, these two plies form a reinforced top panel 53. The side panels 55 and 57 preferably have a height, such that the bottom panel 59 is positioned at the point were the bottle neck N intersects with the bottle's body and the top panel 53 is positioned slightly below the bottle's take-out bead F. As with the carrier 1, the top ply 61 has a plurality (typically, but not limited to, four or six) openings 65 spaced evenly apart in the top ply, preferably in a 2×2 or 2×3 array, as seen in FIG. 15. A similar number of container receiving openings 67 are formed in the bottom ply 63 to be concentric with the openings or surrounding apertures 65 in the top ply. As with the container receiving openings 13 in carrier 1, the container receiving openings 67 have a diameter slightly smaller than the diameter of the bottle neck at the bottle's chime C. (FIG. 14). Slits or scores 69 (FIG. 16) radiate outwardly from the edge of opening 67 to define tabs 71 (FIG. 13). The slits 69 are sufficiently long such that the tabs 71 will form approximately a 60° angle with the carrier top 53 when bottles B are placed in the carrier and the tips of the tabs are engaged with the chime C of the bottle. The width of the tabs 71 at their tips is preferably the same as that of tabs 17 of carrier and thus, the number of tabs will vary, as noted above, with variations in the diameter of the container receiving opening 67. The diameter of the surrounding apertures 65 in the top ply 61 are equal to the diameter of a circle defined by the outer end of the slits 69. Thus, the surrounding apertures 65 define the hinge lines for the tabs, and no scores or embossments are required in the second ply 63 to form a hinge line. The double thickness of the paperboard at the lab's hinge or base produces a stronger tab base for container retention. Without the top ply, which strengthens the tab, the tab 71 may buckle, or otherwise release the bottle.

In addition to the bottle apertures formed in the plies 61 and 63, finger holes 73 (FIG. 16) are formed in the first and second plies, between the rows of apertures 65 and 67 so that the carrier package may be grasped and carried. Openings 77 are formed in the bottom panel 59 so that the box top carrier 51 can be applied over a bottle. The openings 77 are positioned concentrically with the openings 65 and 67 and have a diameter slightly smaller than the diameter of the bottle's neck, near the base of the neck. The openings 77 are shown to be circular and define an area 78 of material between the openings 77.

Figure 16:
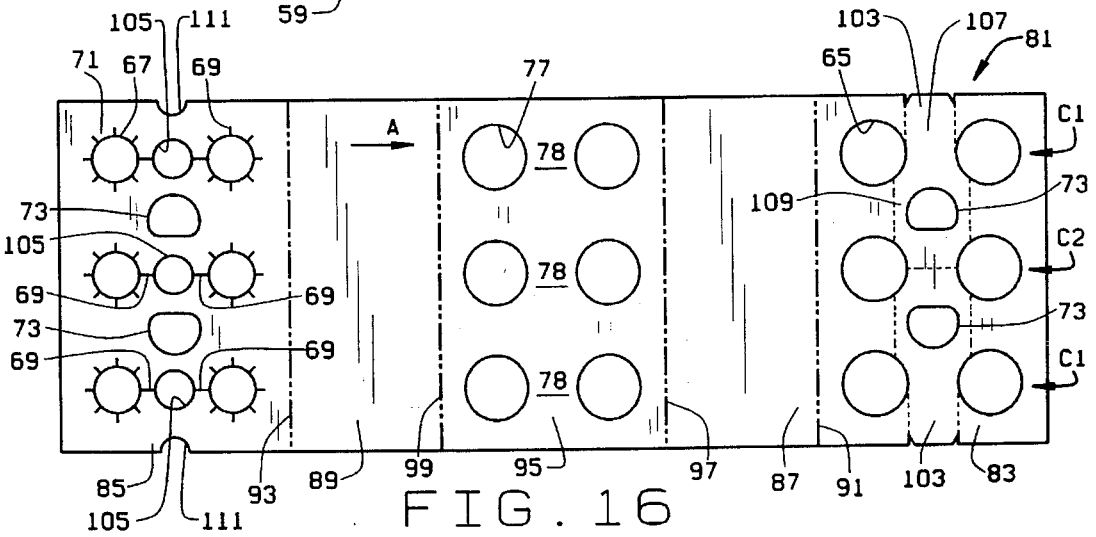
FIG. 16 is a plan view of a carrier blank used to form a box-top type carrier of FIG. 15.

The carrier blank 81 from which carrier 51 is made is shown in FIG. 16. Blank 81 is a one-piece blank, so that carrier 51 is formed from one-piece of paperboard. The blank 81 has two end sections 83 and 85 which form the plies 61 and 63, respectively, of the carrier top 53. Sections 87 and 89 are connected to sections 83 and 85, respectively, and form side panels 55 and 57, respectively. The sections 87 and 89 are separated from the sections 83 and 85 by fold lines 91 and 93. Lastly, a center section 95 is hingedly connected to the sections 87 and 89 along fold lines 97 and 99 to define the bottom panel 59.

Figure 17:
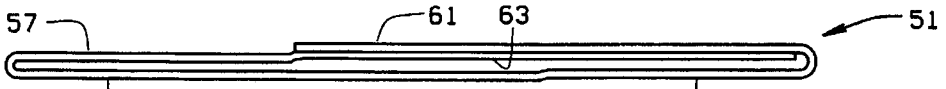
FIG. 17 is a side elevational view of the box-top carrier shown folded flat for bulk shipment.
Figure 18:
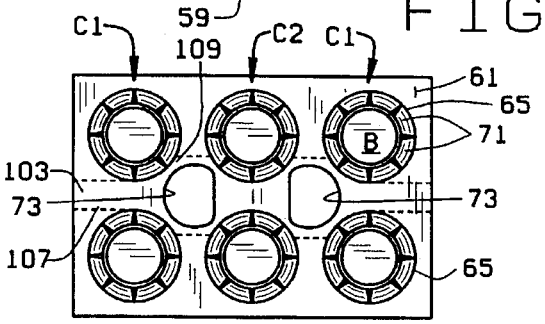
FIG. 18 is a top plan view of the box-top carrier with bottles therein.

The carrier blank 81 is preferably die-cut in a single step. As can be seen, the blank is linear or quadrilateral. The blanks therefore can be formed with a minimum amount of waste. The blanks 81 are folded into carriers 51 using standard folding equipment. In the folding or forming process, the two plies 61 and 63 are glued or bonded together to ensure that the blank is folded into, and remains, a sleeve. Other methods could be used to secure the two plies 61 and 63 together, i.e. they could be stapled or tab locked together. As seen in FIG. 17, the formed blank 51 can be flattened so that the blank can be easily shipped in bulk.

Figure 19:
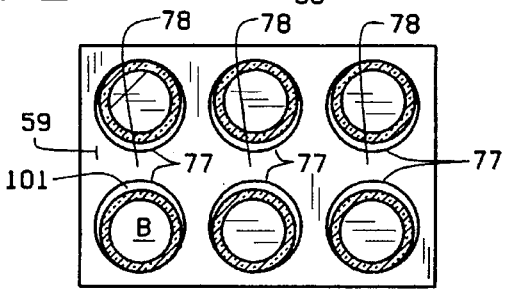
FIG. 19 is a bottom plan view of the box-top carrier with bottles necks therein the necks being shown in cross-section.

To apply the carrier 51 to a group of bottles B, the bottles are initially grouped into an array of the appropriate number of bottles. The carrier is then taken from its flattened state, as shown in FIG. 17, and squared or opened, to its state shown in FIG. 15. The carrier is then simply applied over the tops of the bottles, in the same manner as carrier 1, so that the bottle caps will be forced through the opening 67 to urge the tabs 71 upwardly until the bottle chime C rests or sits on the tabs. As seen best in FIGS. 14 and 19, the apertures 77 in the bottom panel 59 are slightly smaller than the bottle's neck, at the point of the neck where apertures 77 surround the neck. The side panels are of a length, such that when the carrier is applied to the bottles, the top panel 53 will become downwardly arched and the bottom panel 59 will become upwardly arched, as shown in FIG. 14. This brings the outer edges of the aperture 77 in the bottom panel 59 into tighter contact with the outer surfaces of the bottle neck N and the inner edges of the aperture become slightly (preferably minutely) spaced from the bottle neck N, as best seen in FIG. 19 and define a space 101 (shown exaggerated) between the edge of the aperture and the bottle neck. Stated differently, when the carrier is applied over the bottles, the outer edge of the bottom panel openings 77 will contact the bottle edge, and frictionally grip the edge of the bottle. This will cause the bottom panel to arch, as shown in FIG. 14, such that the inner edge of the opening 77 may not contact the bottle, and the bottles will be brought toward each other. The majority of the gripping forces on the bottle neck are thus borne by the outer edges of the openings 77, and little to no fictional contact will occur between the inner edge of the opening 77 and the bottle neck.

When the multi-pack, with bottles therein, is lifted, the outer edge will contact the bottles more forcibly and create a friction grip against the bottle to prevent the bottle from pivoting in the carrier. When the carrier is lifted, the top panel flattens or becomes more planar and pushes the side panels downwardly, relative to the bottles, causing the bottom panel to arch even more. This makes the binding effect of the carrier against the bottle even greater. This will help prevent impacts between the bottles which can crack or break the bottles. Because the arched aspect of the bottom panel facilitates preventing the swinging of bottles, the bottom panel is preferably is made from a single section, and thus has a continuous, uninterrupted side edge. As with carrier 1, the apertures are positioned such that the bodies of the bottles will contact the neighboring bottles. Because the bottles are in contact with each other, the bottles will not be able to swing relative to each other. This, in combination with the binding effect of the carrier on the bottle, will further aid in preventing impacts between the bottles.

As noted, and best seen in FIG. 15, the apertures in the top panel 53 are concentric with the apertures 77 in the bottom panel 59. No offset between the top and bottom apertures are needed to create a binding effect of the carrier on the bottle.

Carrier 51 is provided with release tabs 103 (FIGS. 13 and 16) in the top ply 61 and release openings 105 in the second ply 63 of the carrier's top panel 53. Carrier 51 is not provided with a handle, and has the D-holes 73 which allow for a consumer to lift the carrier by placing his fingers through the holes. The tabs 103 are thus identical to the tabs 29 of carrier 1*a* and blank 20*a*. Tabs 103 include a tab leader 107 and a tab body 109. The tab leader 107 has a width equal to the distance between the two rows of surrounding apertures 65 and extends from the side of the carrier to a point on the diameter of the first column C1 of apertures 65. The tab body 109 extends from the first column C1 of apertures to the middle column C2 of apertures and has a width greater than the width of the finger holes 73 to surround the finger holes 73. Thus, where the perforated edge which defines the tab leader 107 forms a tangent with the surrounding apertures 65, the perforated edges which define the tab body 109 form a secant with the surrounding apertures 65. Thus, the tab forms a portion of the surrounding apertures 65 in an arc of less than 90°. The size of the arc defined by the tab of course depends on the size of the apertures 65. The release openings 105 in the second ply 63 are positioned between the two rows of container receiving openings 67 and lie centered on a line which connects the centers of the two container receiving apertures 67 in a column. The release openings 105 have a diameter approximately equal to the distance between the radial outer ends of tab forming slits 69, such that there is a slit extending between the release opening 105 and the apertures 67 adjacent opening 105. The second ply 63 is also provided with a cutout 111 for each tab 103 to provide access to the tab so that the tab may be easily lifted. The release works in the same manner as discussed above in connection-with carrier 1*a* and shown in FIGS. 29 and 30. When one of the tabs 103 is removed, it exposes the release opening 105 beneath the tab. One of the bottles in the column C1 may then be rotated through the carrier, such that the neck and cap of the bottle breaks through the slit and into the release opening 105. With the bottle neck and cap in the release opening 105, the bottle may then be extracted diagonally out of the carrier. When either of the tabs are pulled, they expose one half of the release opening 105 in the middle column C2. However, because only one-half of the release opening is exposed, the bottle will not be able to be rotated through the slot, and the bottle will remain securely in the carrier. To release the bottles in the middle column C2, both tabs will have to be removed.

A second embodiment 81*a* of the blank is shown in FIG. 20. The blank 81*a* forms a 4-pack and is similar to the blank 81, which forms a 6-pack. Blank 81*a* differs primarily in the finger opening 73*a* in the top ply of section 83*a* of the blank. The finger opening 73*a* is formed as an elongate slot, rather than as a single hole. This will allow a consumer to place more than one finger in the opening, allowing the consumer to get a better grasp of the carrier. The carrier is provided with a release tab 103*a* which is identical to the release tab 29*b* of FIG. 9. The finger hole 73*a* is not wider than the area separating the two columns of apertures 65*a*, and thus, the tab 103*a* is formed as a straight tab which has edges tangential to the apertures 65*a*. In the section 85*a* which forms the bottom ply of the carrier's top panel, the finger opening and the release opening are combined to form a single elongate opening 113 which has circular ends which sized to extend to the tab forming slits 69*a*. The carrier is provided with a single tab 103*a*. Thus, when the tab is pulled, all four bottles will be ready for release from the carrier. However, the tab 103*a* could be provided with a cross-perforation which would divide the tab 103*a* into two tabs of equal size. This would allow only desired bottles to be released.

Figure 21:
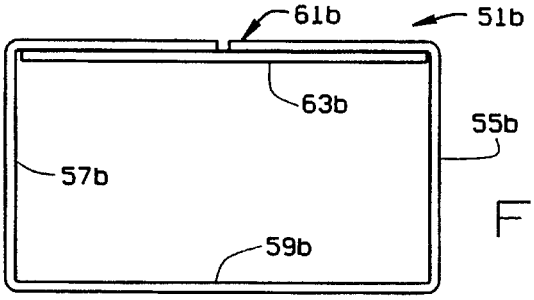
FIG. 21 is a side elevational view of a fourth embodiment of the box-top carrier.
Figure 22:
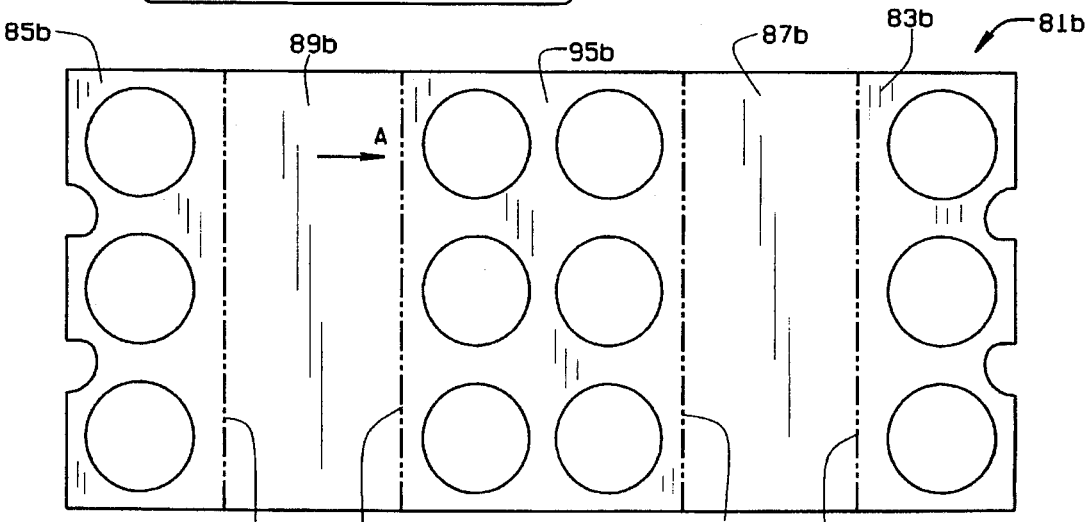
FIG. 22 is a plan view of a carrier blank used to form an outer portion of the box-top carrier of FIG. 21.
Figure 23:
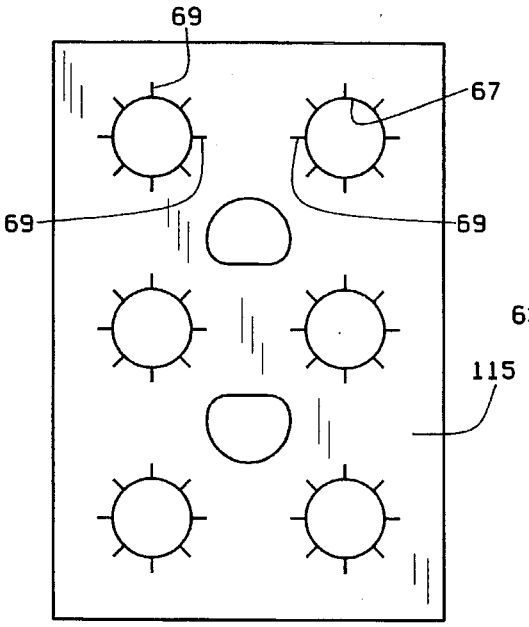
FIG. 23 is a plan view of a carrier blank used to form the second ply of the box-top carrier of FIGS. 21 and 24.

A third embodiment of the box-top carrier 51*b* is shown in FIG. 21. Box-top carrier 51*b* is made of two blanks. A first blank 81*b* (FIG. 22) has a center section 95*b* which forms the bottom panel 59*b*, sections 87*b* and 89*b* which form the side panels 55*b* and 57*b*, and outer sections 83*b* and 85*b*, each of which form one-half of the top panel 61*b*. Unlike the blank 81 (FIG. 16), the sections 83*b* and 85*b* of blank 81*b* form two halves of the top ply 61*b* of the carrier. The second ply 63*b* is formed by a second blank 115 (FIG. 23). Second blank 115 is substantially identical to the section 85 of blank 81 and forms the container receiving apertures 67 of the reinforcing ply and has the tab forming slits 69. Carrier 51*b* is formed by folding the blank 81*b* along its fold lines 91*b*, 93*b*, 97*b*, and 99*b* to form the outer surfaces of the carrier 51*b*. The reinforcing ply 63*b* comes from blank 115. The two halves of the top ply are glued to the reinforcing ply to form the carrier 51*b*. This construction, although made of two pieces, allows for the use of different materials or materials of differing strengths. For example, one ply can be made from 28 weight paperboard and the other from 24 weight paperboard. Carrier 51*b* is not shown to be provided with release tabs or release openings. The carrier 51*b* can be provided with a release, such as shown in FIGS. 37–42, and which are described below. However, it has been found that the bottles can be fairly easily removed from the carrier by pressing straight down the bottle's crown, for example, with the consumer's thumb. The force exerted by pressing or pulling straight down on the bottle overcomes the holding force of the tabs 71 and the bottle will be released from the carrier.

Figure 24:
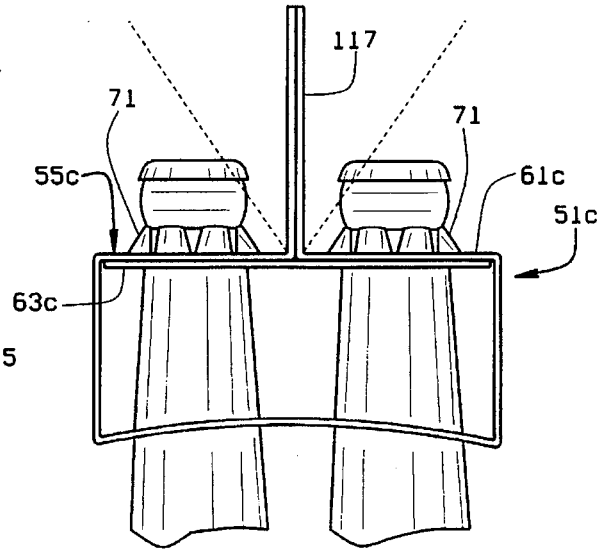
FIG. 24 is a side elevational view of a fifth embodiment of the box-top carrier, the box-top carrier being provided with a center handle.
Figure 25:
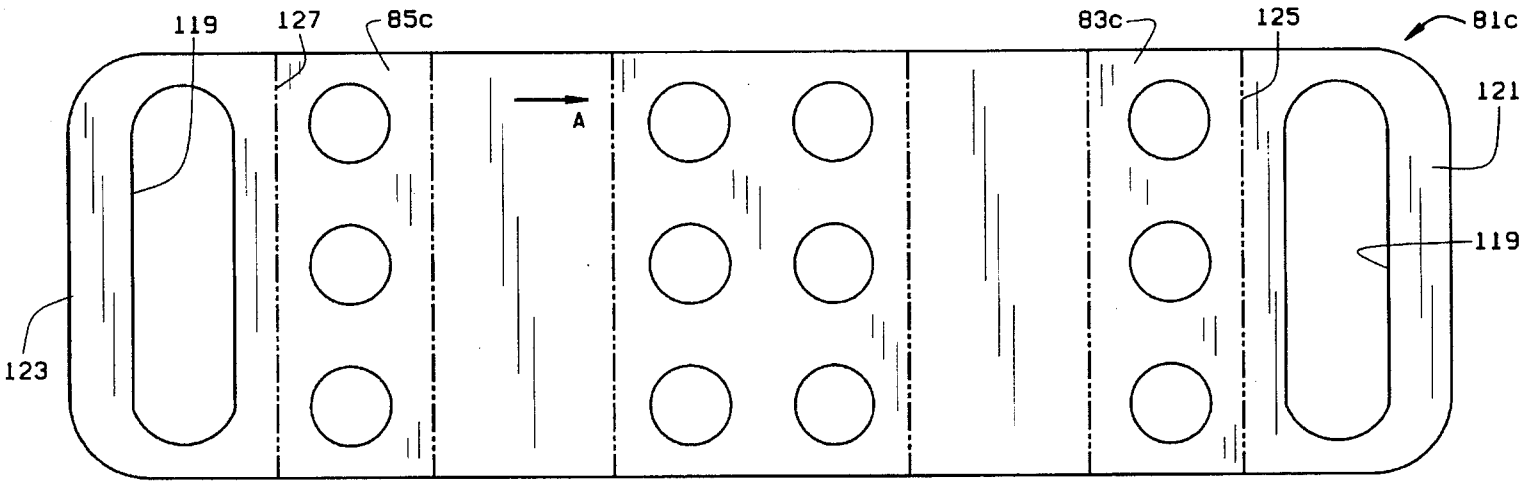
FIG. 25 is a plan view of a carrier blank used to form the outer portion of the box-top carrier of FIG. 24.

A fourth embodiment of the box-top carrier 51*c* is shown in FIG. 24 and the blank 81*c* which forms carrier 51*c* is shown in FIG. 25. Carrier 51*c* is similar to the carrier 51*b* (FIG. 21) in that it is a two-piece carrier, that is, the second ply 63*c* of the carrier top 55*c* is formed from a separate sheet of paperboard than the top ply 61*c*. Carrier 51*c*, however, is provided with a handle 117 having hand holes 119 to facilitate carrying of the carrier 51*c* when it contains bottles The second or reinforcing ply 63*c* is identical to the reinforcing ply 63*b* of carrier 51*b*, and is made from the blank 115 shown in FIG. 23.

The carrier blank 81*c* (FIG. 25) is similar to the carrier blank 81*b* (FIG. 22), with the addition of handle forming portions 121 and 123 which form the outer-most portions of the blank. The handle forming portions 121 and 123 are hingedly connected to portions 83*c* and 85*c* along hinge or fold lines 125 and 127. As noted above, in connection with blank 81*b*, the portions 83*c* and 85*c* of blank 81*c* each define one-half of the top ply 61*c* of the carrier (FIG. 24). Thus, as seen in FIG. 24, the handle 117 extends from the center of the carrier and is a two ply handle. The hand holes 119 in the handles 117 are preferably sized so that the handle can be folded down over the crowns and a portion of the necks of the bottles. When the handles 117 are folded down, there would be no portion of the carrier 51*c* which extends above the tops of the bottles. The handles need not lie flat against the top panel 61*c*. Thus, this carrier may be stacked in a store, and when a consumer selects a package, he can unfold or lift up the handles for ease of carrying the multi-pack.

The box-top carrier 51*c* (FIG. 24) is formed from the blank 81*c* (FIG. 25) by folding the blank along its hinge or fold lines 125 and 127 forming handle portions 121 and 123 together along their adjoining faces. This produces a two-ply handle which is more rigid. The second ply 63*c* formed from blank 115 (FIG. 23) is glued to the bottom surface of ply 61*c*. The step of gluing the second ply 63*c* to the top ply 61*c* can be performed at any time during the construction of carrier 51*c*. For example, it can be done after the handle forming portions 121, 123 are secured together, or it can be done while the blank 81*c* is being folded.

Figure 26:
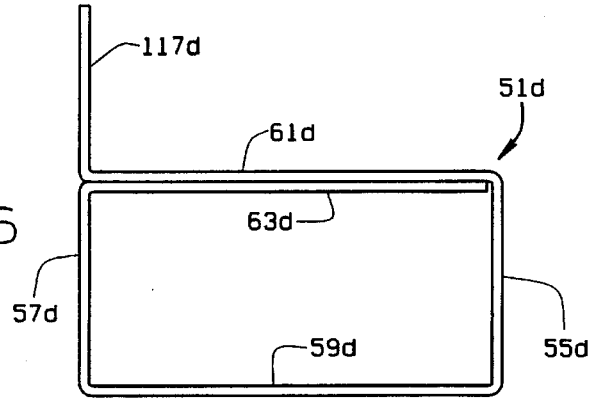
FIG. 26 is a side-elevational view of a sixth embodiment of the box-top carrier, the carrier being provided with a side handle.
Figure 28:
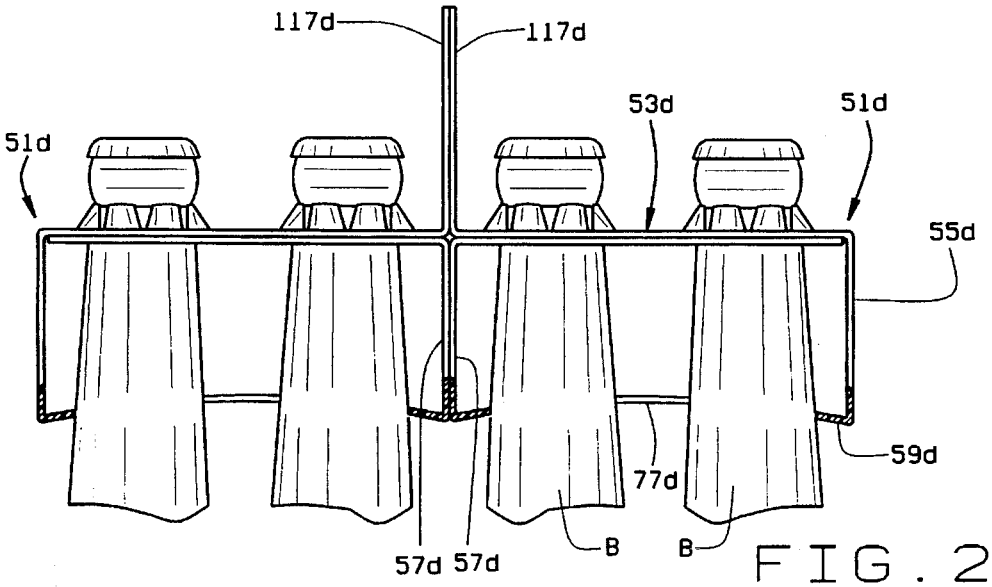
FIG. 28 is a side elevational view of two box-top carriers of FIG. 26, partly in cross-section, combined together to form a dual-pack with a center handle.
Figure 27:
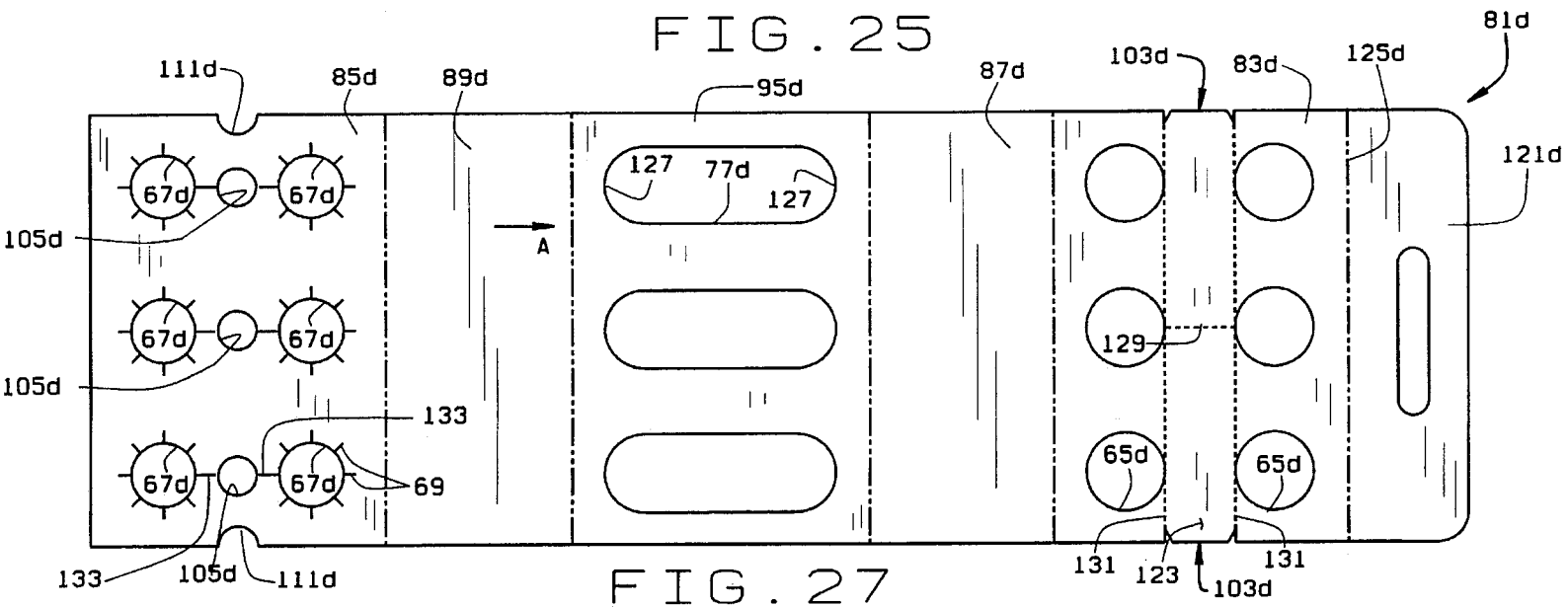
FIG. 27 is a plan view of a carrier blank used to form the box-top carrier of FIG. 26, the box top carrier from the blank being provided with a release mechanism.

A fifth embodiment of the box top carrier 51*d* is shown in FIG. 26 and the blank 81*d*, from which it is formed, is shown in FIG. 27. The carrier 51*d* is a one-piece, integral, unitary carrier, like carrier 51 (FIG. 15), with the addition of a handle 117*d*. Handle 117*d*, however, is positioned at the side of the carrier 51*d*, rather than in the center of the carrier, such as with carrier 51*c*. This package can act or perform alone. However, it gives the advantage of being able to attach two carriers 51*d* together to form a dual-pack, as is shown in FIG. 28. In forming the dual-pack of FIG. 28, the two carriers 51*d* are joined together by gluing or otherwise securely connecting sides 57*d* and handles 117*d*.

In FIG. 27, it can be seen that the blank 81*d* is similar to the blank 81 (FIG. 16) which forms the carrier 51. Blank 81*d*, however, contains a single handle forming portion 121*d* hingedly connected to portion 83*d* by fold line 125*d*. The handle 117*d* formed from section 121*d* is thus a single-ply handle, which becomes a two-ply handle when two carriers 51*d* are joined together to form a dual-pack. In this carrier blank, portion 83*d* forms all of the top ply 61*d* of the carrier 51*d*. Blank 81*d* and carrier 51*d* also provide for a larger opening 77*d* in the bottom panel 59*d* of the carrier. As seen best in FIGS. 27 and 28, the opening 77*d* is an oval opening which is sized to encompass the two bottles in a single column, eliminating the area 78 of paperboard separating the bottles, as in carrier 51 (FIG. 15). The oval openings 77*d* are sized to have a radius at its focal points slightly smaller than the radius of the bottle neck N at the point where the carrier bottom 59*d* surrounds the neck N, so that the openings 77*d* will engage the bottle neck at the desired point. The length of the oval is sized so that the circular edges 127 of the oval openings 77*d* contact the side of the bottle closest to the carrier sides 55*d* and 57*d* when the carrier is filled with bottles. This provides the carrier 51*d* with the friction grip explained in connection with the operation of the carrier 51 to inhibit swinging of the bottles while in the carrier. As set forth above, this will prevent impacts between the bottles which are great or strong enough to crack or break the bottles. Further, it has been found that when circular openings, such as openings 77 of carrier 51, are used in the bottom panel 59, the edge of the openings in the center of the carrier (e.g. which form the edge of area 78), can bind against the bottle when the bottle is being removed from the carrier. The carrier 51*d* (FIG. 26) eliminates the area 78, and thus eliminates the possibility of the carrier binding against the bottle where such binding is undesired. Because the bottles are positioned in the carrier with their bodies in contact with each other, the area 78 does not add to the anti-sway property of the carrier. Thus, even with the area 78 of paperboard between the openings 77 (FIG. 16) removed, the bottles will not swing relative to each other, and the potential for the bottles to impact each other is substantially eliminated. The same effect could be produced by making the opening 77 slightly oval, such that the area 78 between the openings 77 of carrier 51 is reduced in dimension. This will create a larger gap 101 (FIG. 19) between the bottle and the carrier, and the inner edge of the opening 77 will not bind against the bottle as the bottle is being removed from the carrier.

Figure 31:
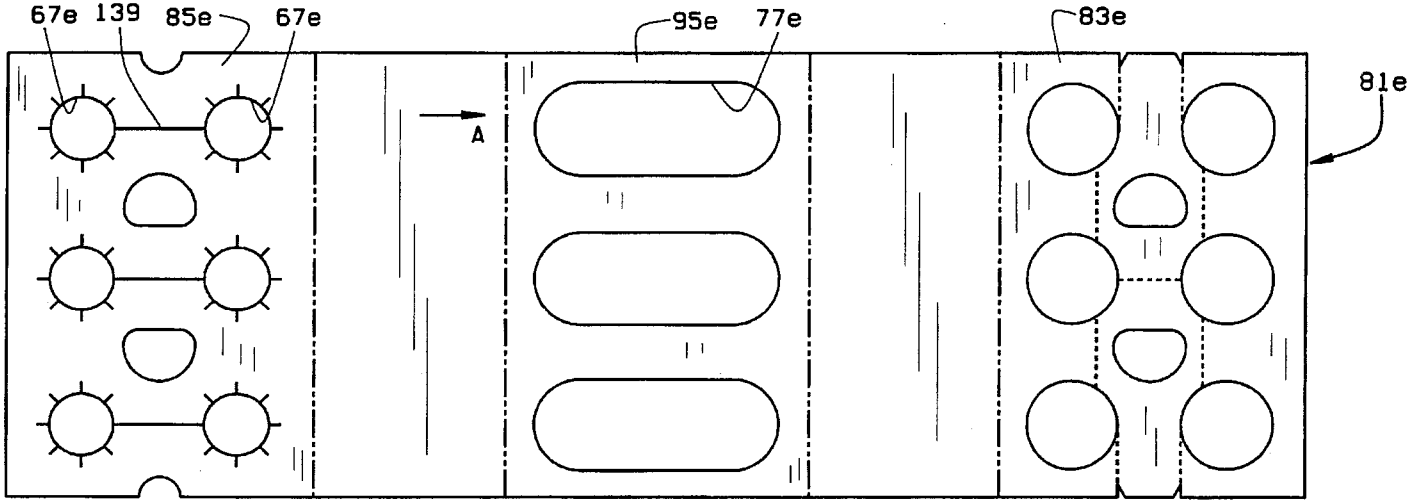
FIG. 31 is a plan view of a sixth embodiment of the carrier blank, similar to the blank of FIG. 16, but having slits rather than release holes in the bottom ply of the top panel of the carrier.

The carrier 51*d* (FIG. 26) is also provided with a release mechanism (shown on the blank 81*d* which forms carrier 51*d*) which will allow a consumer to easily remove individual bottles from the carrier 51*d*. The release mechanism includes two oppositely directed pull-tabs 103*d* (FIG. 27) formed in the top ply section 83*d* of the carrier blank 81*d*. The pull tabs 103*d* are identical to the pull tabs 29*c* (FIG. 11) of carrier 1*c* and extend from the side of the carrier to the middle of the carrier, where the tabs are separated by a perforated line 129. The tabs 103*d* have a width equal to the distance between the surrounding apertures 65*d* and the tab's edges 131 are thus tangential to the surrounding apertures 65*d*. The perforated lines 129 and 131 extend through the top ply section 83*d* to facilitate easy removal of the tab 103*d* from the top ply. The bottom ply section 85*d* is provided with semi-circular cut-outs 111*d* which are aligned with the tab to facilitate grasping of the tab. The release mechanism also includes smaller diameter release openings 105*d* placed between the two columns of container receiving openings 67*d*. The openings 105*d* are shown to be circular in FIG. 27, and are preferably placed so that the centers of the three openings (i.e. the container receiving openings 67*d* and release opening 105*d*) are colinear. The openings 105*d* are centered between the two columns of apertures 67*d* on either side of the openings 105*d* and are connected to the openings 67*d* by means of a slit 133. Slit 133 preferably extends radially from each opening, and thus lies along the diameter of both the openings 67*d* and the opening 105*d*. The slit 133 preferably extends through the second ply section 85*d*. The slit 133 may be one of the tab-forming slit 69, or may be a modified tab-forming slit. The opening 105*d* is shown to be circular, but can be made as a single slit 139 (as shown in FIG. 31) which extends between the two container receiving openings 67*e*. Alternatively, the opening 105*d* can be formed as a narrow, elongate slot formed between the openings 67*d* and which connect the two slits 133.

The operation of the release mechanism is shown in FIGS. 29 and 30. Initially, the tab 103*d* is grasped and pulled along the perforations to separate the pull tab 103*d* from the top ply 61*d*. Although the perforation 131 forms a tangent with the surrounding aperture 65*d*, when the tab is removed from the top ply, the surrounding aperture 65*d* will be partially opened, as at 135 (FIG. 29). This will remove a portion of the edge of aperture 65*d* and expose the second ply 63*d* to expose the opening 105*d* and the slit 133. When the pull tab 103*d* has been removed, the bottle B1 may be "walked" out of the carrier 51*d*. As seen in FIG. 30, the upper left bottle B1 is tilted so that the neck of the bottle is directed inwardly, towards the center of the carrier 51*d*. As the bottle is so tilted, the neck N of the bottle B1 will pass through the opening 135 in aperture 65*d*, break through the slit 133, and enter the opening 105*d*. The slit 133 and opening 105*d* thus create an openable area 135 through which the bottle may be easily pulled. The presence of the pull tabs, however, prevent the openings 105*d* and slit 133 from affecting the integrity of the carrier top 53*d* when the pull tabs are in place. Because the pull tabs 103*d* each only extend one-half the length of the carrier 51*d*, removal of a pull tab only affects the two end bottles in the carrier. Removal of the tab exposes half of the middle release opening 105*d*. But, because only one-half of the middle release opening is exposed, removal of one tab does not significantly affect the hold of the carrier on the middle two bottles. The openings 105*d* and slits 133 at the center and opposite end of the carrier will be at least half covered, so that the bottles in those rows will not be able to be pulled through the hole 105*d* and slit 133.

The carrier may also be used to carry empty bottles to facilitate recycling of bottles. The ends of the tabs can be passed though the slits 133, such that the ends of the tabs will be beneath the bottom ply 63*d*. With the tabs so positioned, the top panel 53*d* will be sufficiently strong to carry empty bottles.

A carrier blank 81*e* for another embodiment of the box top carrier is shown in FIG. 31. This blank is substantially the same as the blank 81 shown in FIG. 16. The blank 81*e* varies from the blank 81 only in the release mechanism and in the openings in the bottom panel. In the section 95*e*, which forms the bottom panel of the carrier, the openings 77*e* are oval and encompass both bottles of a column similarly to openings 77*d* of FIG. 27. In the release mechanism, the release openings are replaced with slits 139 which extend between the apertures 67*e* in the section 85*e* which forms the second ply of the carrier top panel. The replacement of the release opening with a slit does not affect the operation of the release mechanism. The slit 139 still provides a manner for the bottle neck and cap to be rotated through the top panel of the carrier. The section 83*e*, which forms the top ply of the carrier's top panel is identical to section 83 of blank 81 (FIG. 16).

Figure 33:
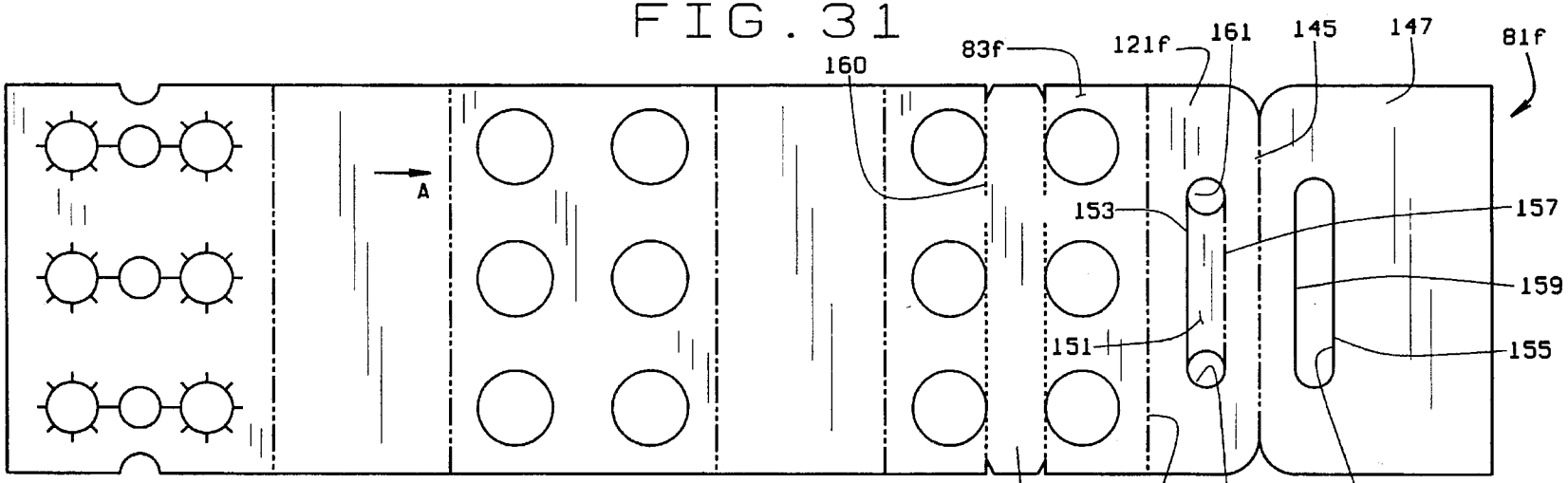
FIG. 33 is a plan view of a carrier blank for the box-top carrier of FIG. 32.
Figure 32:
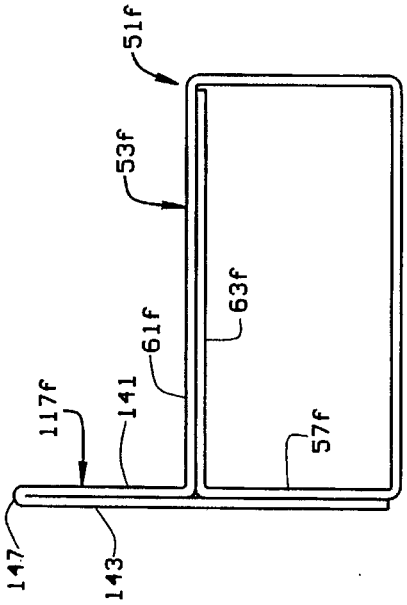
FIG. 32 is a side elevational view of a seventh embodiment of the box-top carrier, the box top carrier being provided with a two-ply side handle.

A sixth embodiment of the box-top carrier 51*f* is shown in FIG. 32 and the carrier blank 81*f* from which it is made, is shown in FIG. 33. Carrier 51*f* is similar to carrier 51*d* (FIG. 26) but provides for a two-ply handle 117*f*, rather than the one-ply handle 117*d* of carrier 51*d*. The handle 117*f* includes a first ply 141 and a second ply 143 which are hingedly connected together along a fold line 145 (FIG. 33) which forms the top 147 of the handle. The first ply 141 of the handle is hingedly connected to the top ply 61*f* of the carrier top 53*f*. The handle's outer ply 143 is longer than the first ply 141 and extends at least partially along the side 57*f* of the carrier 51*f*. Preferably, the ply 143 extends nearly to the bottom of wall 57*f*.

Figure 34:
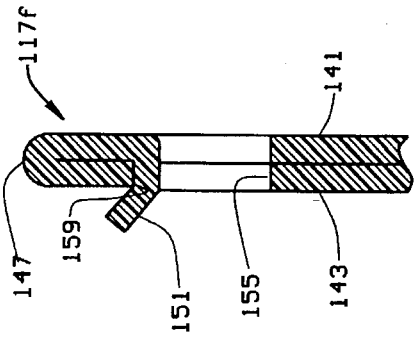
FIG. 34 is a cross-sectional view of the handle of the box-top carrier of FIG. 32.

The carrier blank 81*f* (FIG. 33) is substantially the same as the blank 81 (FIG. 16) but is provided with handle forming portions 121*f* and 147 which form the first ply 141 and second ply 143 of the handle 117*f*, respectively. The portion 121*f* is hingedly connected to portion 83*f* along a fold line 125*f*. The position 147 is provided with an elongate, generally oval cut-out 149. A flap 151 is formed in portion 121*f* in an area corresponding to the cut-out 149. The flap 151 is defined by a slit 153 which is positioned to be aligned with the bottom edge 155 of cut-out 149 and a fold line 157 positioned to be aligned with the top edge 159 of cut-out 149. The sides of flap 151 are formed by two small diameter circular cut-outs 161. As seen in FIG. 34, the flap 151 covers the edge 159 of the cut-out to provide a generally smooth surface to the consumer. This will reduce the amount that the carrier handle 117*f* bites into the consumer's hand, making the carrier 51*f* (FIG. 32) more comfortable to carry. The handle 117*f* is along the side of the carrier. Thus, two carriers 51*f* may be secured together to form a dual-pack carrier.

The release tabs 103*f* of carrier 51*f* are modified slightly. Rather than having the perforations which form the tab extending from edge to edge, perforations are not formed for a short distance as at 160, as seen in FIG. 33. This will facilitate retention of the release tab on the carrier so that it will not be pulled off by the user to create litter. This feature can be applied to any of the release mechanisms disclosed herein.

The carrier 51*f* provides more bonding surface in forming the carrier and in forming a dual-pack carrier. The top and second plies 61*f* and 63*f* may be glued or bonded together and the handle second ply 143 may be secured to the handle first ply 141 and the side 57*f* of the carrier. A portion of the bottom half of the handle second ply 143 need not be secured to the side 57*f*. Such a portion could be separated from the rest of the second ply by a perforation, and the bottom most part of the ply could be provided with coupons, which could then be easily removed from the carrier 51*f*.

Figure 35:
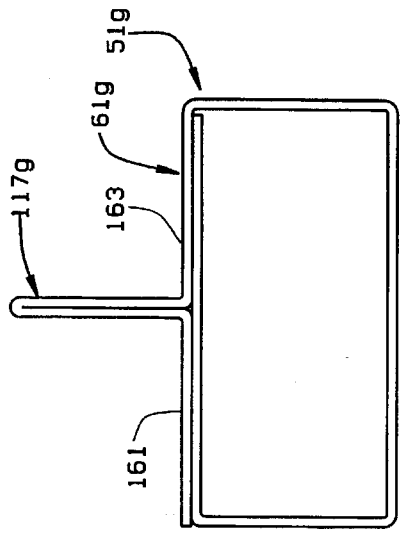
FIG. 35 is a side elevational view of a eighth embodiment of the box top carrier, the box top carrier having a second form of a center handle.
Figure 36:
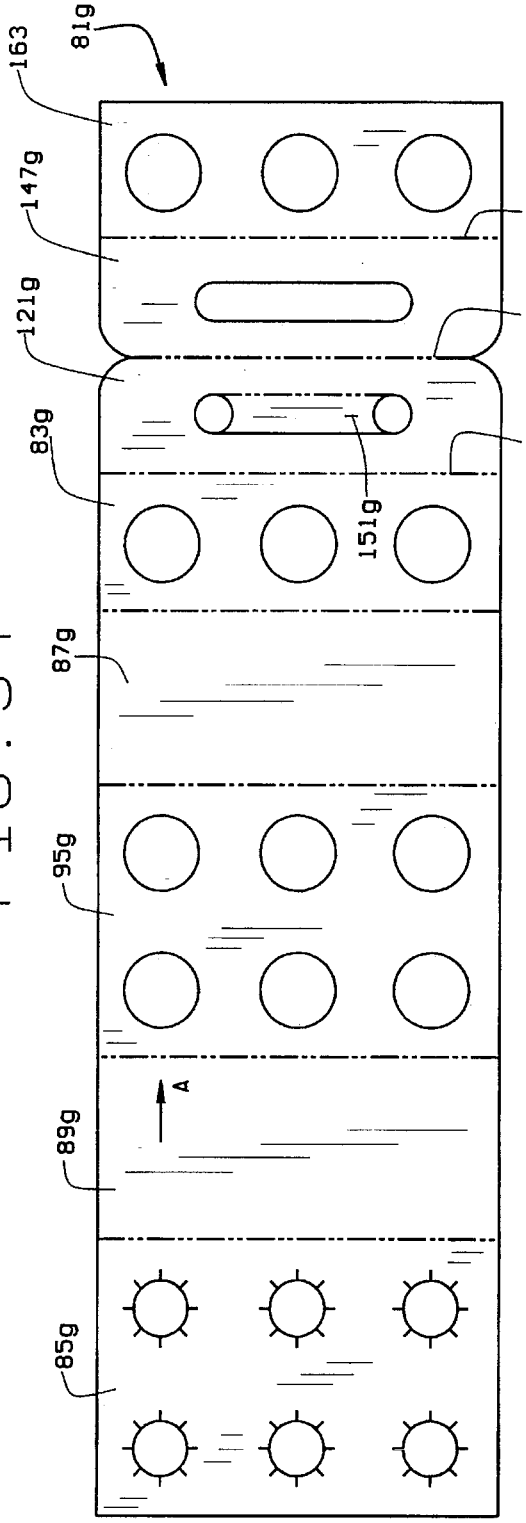
FIG. 36 is a plan view of a carrier blank for forming the box top carrier of FIG. 35.

A sixth box-top carrier 51*g* is shown in FIG. 35 and its blank 81*g* is shown in FIG. 36. The carrier 51*g* includes a handle 117*g* which is a two-ply handle and extends from the center of the carrier, and separates the top ply 61*g* of the carrier into two halves 161 and 163. Turning to FIG. 36, the blank includes portion 85*g* which forms the second ply of the carrier's top panel, portions 87*g* and 89*g*, which form the sides of the carrier, and portion 95*g* which forms the bottom panel of the carrier. These portions are identical to those of carrier blank 81 (FIG. 16). A portion 83*g* is hingedly connected to the portion 87*g* and defines the first half 163 of the top ply 61*g*. The handle 117*g* is defined by two portions 121*g* and 147*g*. Portion 121*g* is hingedly connected to portion 83*g* by a fold line 125*g*, and portion 147*g* is hingedly connected to portion 121*g* by a fold line 145*g*. The second half 161 of top ply 61*g* is formed by blank portion 163 which is hingedly connected to portion 147*g* by a fold line 165. The handle 117*g* is similar to the handle 117*f* (FIG. 34) in that it is provided with the hand protecting flap 151*g*. However, the two portions 121*g* and 147*g* of the blank are the same size. Although carrier 51*g* is not shown to have a release mechanism, it could be provided with the release mechanism of FIGS. 37–42.

Figure 37:
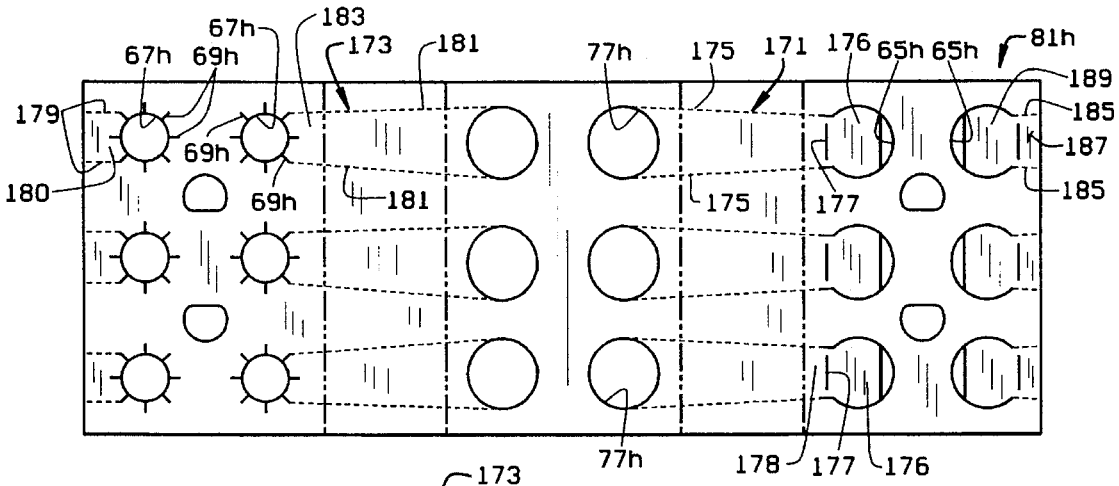
FIG. 37 is a plan view of a carrier blank for forming a ninth embodiment of the box-top carrier, the carrier being provided with an independent release tab for each bottle.
Figure 38:
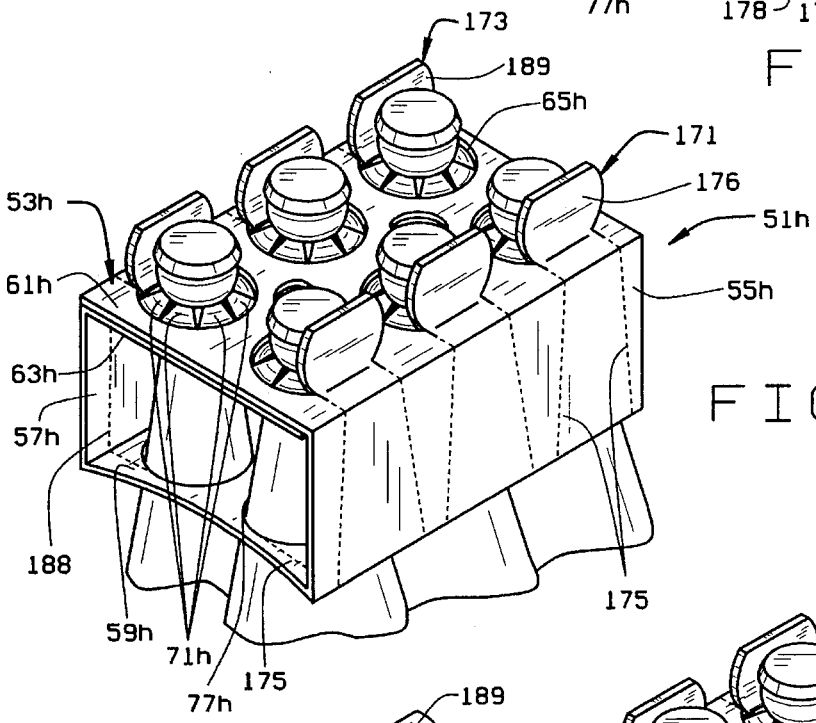
FIG. 38 is a perspective view of the box-top carrier formed from the blank of FIG. 37.
Figure 39:
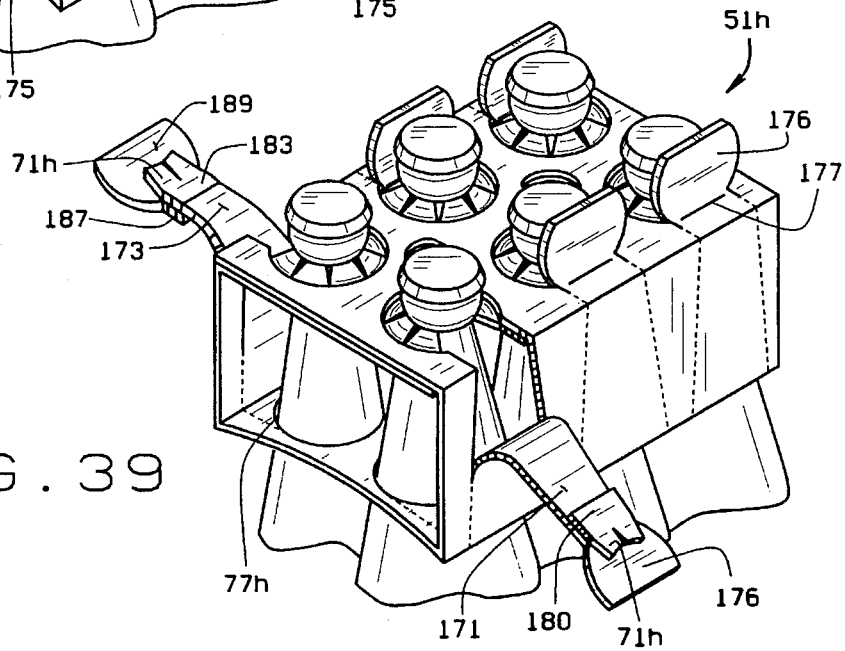
FIG. 39 is a perspective view of the box-top carrier of FIG. 37, with two of the release tabs being pulled.

A ninth embodiment 51*h* of the box-top carrier is shown in FIGS. 38 and 39, and its blank 81*h* is shown in FIG. 37. The carrier 51*h* is similar to the carrier 51 (FIG. 15) and includes top panel 53*h*, side panels 55*h* and 57*h*, and a bottom panel 59*h*. The bottom panel 59*h* includes openings 77*h* through which the bottle neck extends. The top panel 53*h* is made of two plies 61*h* and 63*h*. The top ply 61*h* includes surrounding apertures 65*h* and the second ply 63*h* includes container receiving apertures 67*h* and slits 69*h* (FIG. 37) which form tabs 71*h*. Carrier 51*h*, however, is provided with a different release tab. Instead of having a tab which extends down the middle of the top panel of the carrier, the carrier 51*h* includes an individual release tab for each bottle in the carrier. Tabs 171 are provided for one row of bottles and tabs 173 are provided for the second row of bottles.

The tabs 171 are defined by a pair of perforated lines 175 which extend from the aperture 65*h* in the top ply 61*h* to the opening 77*h* in the bottom panel 59*h*. A finger grasp 176 is formed at the top of tab 171. When the surrounding aperture 65*h* is formed, the material inside the aperture is not all removed. This middle material defines the finger grasp 176. The grasp is provided with a fold line 177 which is approximately the same distance to the edge of the carrier as is the surrounding aperture 65*h*. The area between fold line 177 and the edge of the carrier defines an area 178. The corresponding container receiving apertures 67*h* in the second ply 63*h* are provided with perforated lines 179 which extend from the aperture 67*h* to the edge of the carrier to define a portion 180. Portion 180 is glued, or otherwise secured, to the portion 178 of the tab 171 so that when the finger grasp 176 is pulled, the portion 180 will be removed from the second panel 63*h* to open both the surrounding aperture 65*h* and the container receiving aperture 67*h* to the edge of the carrier, as seen in FIG. 39.

The tabs 173 are defined by a pair of perforated lines 181 which extend from the container receiving aperture 67*h* in the second ply 63*h* to the opening 77*h* in the bottom panel 59*h*. The perforated lines 181 extend from a pair of the tab forming lines 69*h* to form an area 183 between the container receiving apertures 67*h* and the edge of the ply 63*h*. The corresponding surrounding apertures 65*h* in the top ply 61*h* are provided with perforated lines 185 which extend from the aperture 65*h* to the edge of the carrier to define a portion 187. Finger grasps 189 are formed in the top panel 61*h*, in the same manner as finger grasps 176. The area 187, which is integral with finger grasp 189, is glued, or otherwise secured, to the area 183 of tab 173. Thus, when the finger grasp 189 is pulled, the portion 187 will pull tab 173 with it, to open both the surrounding aperture and the container receiving aperture.

The perforated lines 175 and 181 separate from top to bottom such that the tabs 171 and 173 form truncated triangles. The tabs thus widen from top to bottom and tearing through the apertures 77*h* so that the tab has a shape corresponding to the shape or outline of the bottle neck. This facilitates removal of the bottle from the carrier.

Figure 40:
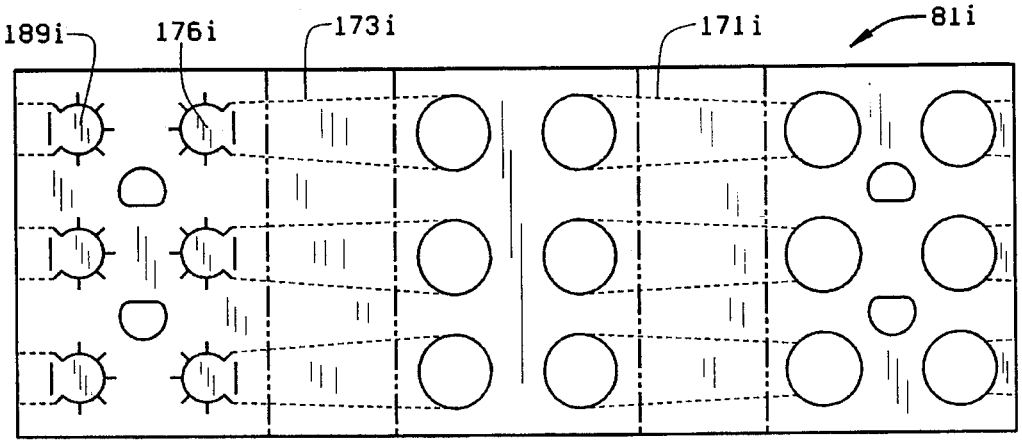
FIG. 40 is a plan view of a carrier blank for forming a tenth embodiment of the box-top carrier, the carrier being provided with an alternate form of the independent release tab for each bottle.
Figure 41:
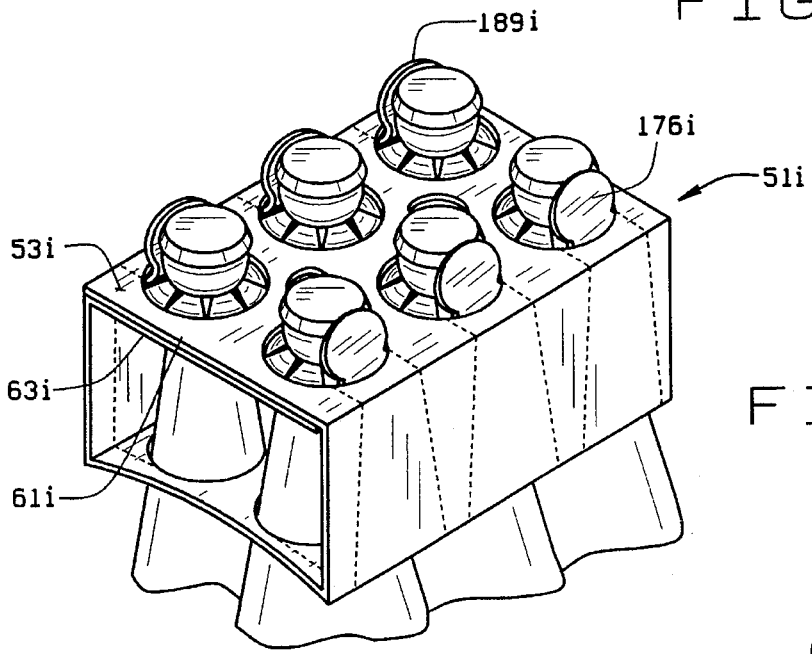
FIG. 41 is a perspective view of the box-top carrier formed from the blank of FIG. 40.
Figure 42:
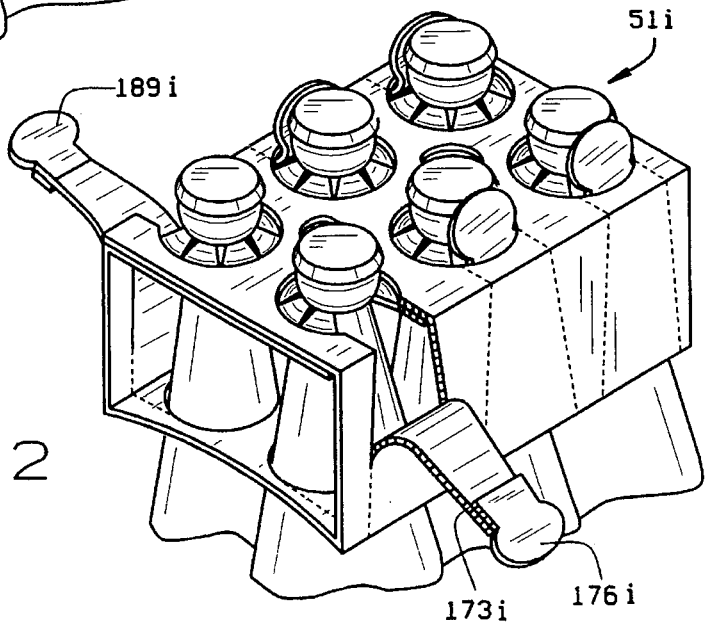
FIG. 42 is a perspective view of the box-top carrier of FIG. 41, with two of the release tabs being pulled.

A box-top carrier 51*i* and its blank 81*i* are shown in FIGS. 40–42. The carrier 51*i* is similar to the carrier 51*h* (FIG. 38) and includes release tabs 171*i* and 173*i* which are substantially similar to the release tabs 171 and 173 of carrier 51*h*. However, the finger grasps 176*i* and 189*i* are formed in the second ply 63*i* of the carrier top panel 53*i*. Thus, the finger grasps are formed from the material which define the interior of the container receiving apertures and extend through the top ply 61*i* when bottles are placed in the carrier.

Figure 43:
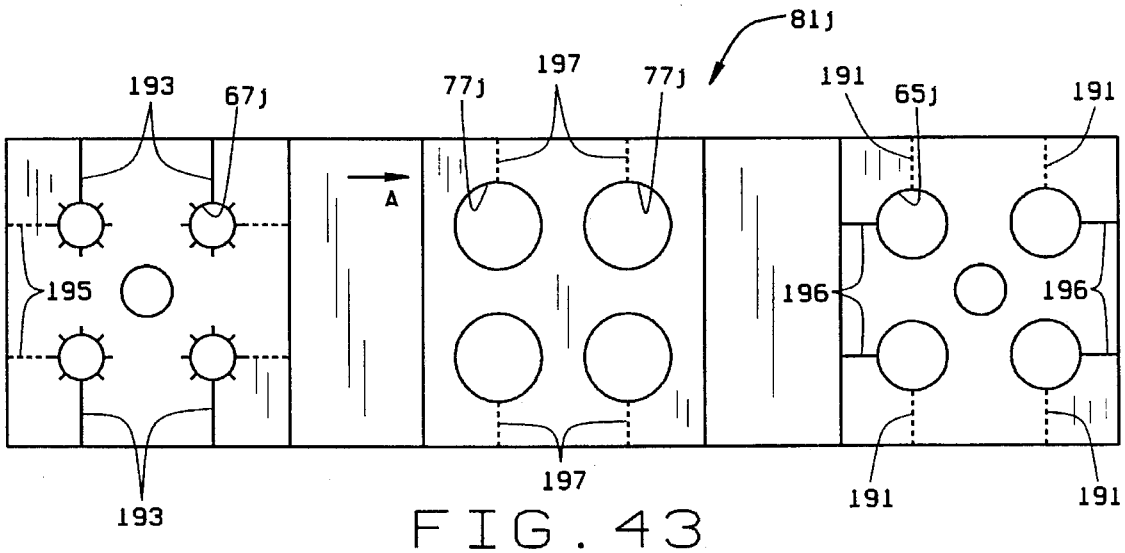
FIG. 43 is a plan view of a box-top carrier blank which forms a 4-pack carrier, the 4-pack carrier being provided with a third type of release mechanism.
Figure 44:
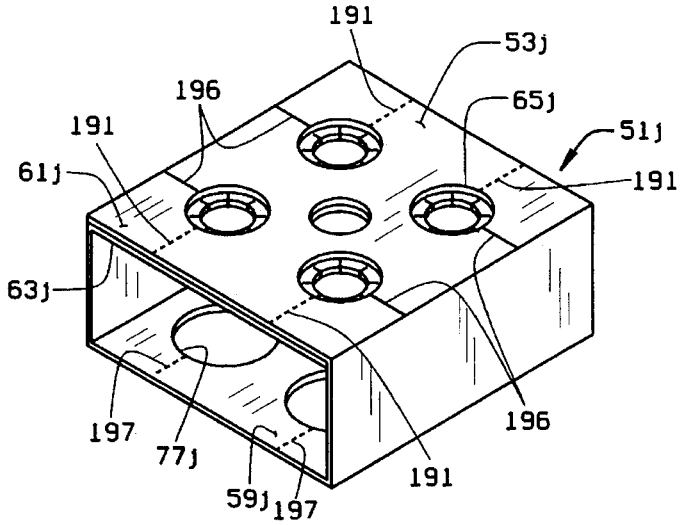
FIG. 44 is a perspective view of the box-top carrier formed from the blank of FIG. 43.

A four-pack carrier 51*j* and its blank 81*j* are shown in FIGS. 43 and 44. Carrier 51*j* is provided with a third type of release mechanism. Rather than having a pull tab, carrier 51*j* is provided with slits and perforations which allow a corner of the carrier to be hinged away. The top ply 61*j* of the carrier is provided with a perforated line 191 and a slit 196 which extend radially from the surrounding apertures 65*j*. The perforated line 191 and slit 196 are perpendicular to each other, extending from each surrounding aperture to an edge of the carrier. The second ply 63*j* is provided with slits 193 which extend from the container receiving apertures 67*j* to an edge of the carrier and perforated lines 195 which extend from the container receiving apertures to edges of the carrier. The slits 193 and perforations 195 are perpendicular to each other and are positioned on the second ply of the carrier to be aligned with the perforated lines 191 and slits 196 in the top ply. For each hole the slits are preferably aligned with the perforated lines, such that the slits are not aligned with each other. To open this package, the user simply pushes up or down on the corner with sufficient force to separate the perforated lines. This will open the apertures 65*j* and 67*j* in the top panel 53*j* of the carrier, and the bottle can then be easily extracted from the carrier. The tear lines of this release are shown to be perpendicular to each other. It will be apparent, that most any angle defined by the two tear lines will suffice, as long as the tear lines extend to adjacent edges of the carrier's top panel. Although a set of two tear lines in each ply of the top panel are used, it will be apparent that a single perforated line extending from each aperture to a corner of the carrier top panel will also work.

As can be appreciated, our carrier provides a strong carrier which engages the bottles at their chimes, rather than at their caps or crowns to facilitate removal of the bottle from the carrier. Further, the carrier is provided with a release mechanism to facilitate release of the bottles from the carrier so that the bottles do not have to be pulled or pushed vertically through the tabs 17 of the carrier. The strength of the paperboard used allows for the carrier to be reused to facilitate recycling of the bottles initially placed in the carrier. That is, the bottles, once used, can be placed back in the carrier, and the carrier will be sufficiently strong to carry the empty bottles. The carriers are made from rectangular blanks which may be produced at high speed, for example, printed and die cut in a stamping operation and may be shipped flat in bulk.

In forming or cutting the blanks, the blanks are preferably formed, but not necessarily, to have a long axis parallel to the-machine direction, as shown by the arrow A in the drawings. By forming the blanks so, the fold lines will, for the most part, be normal or perpendicular to the machine direction. With the grain of the paperboard oriented in this manner, the grains will run generally vertically in the side panels and generally perpendicular to the long axis of the top and bottom panels. This will increase the rigidity or strengthen the side panels to resist arching in the side panels. Similarly, in the top and bottom panels, this grain orientation will give strength to the arch, and hence the panel. The stronger arch will tend to hold the bottles together more firmly.

Figure 10A:
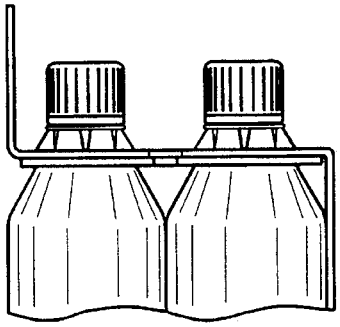
FIG. 10A is a side elevational view of the carrier of FIG. 10, but wherein the carrier includes a single-ply handle and the second ply of the top panel is not integrally formed with the blank which forms the carrier.
Figure 11A:
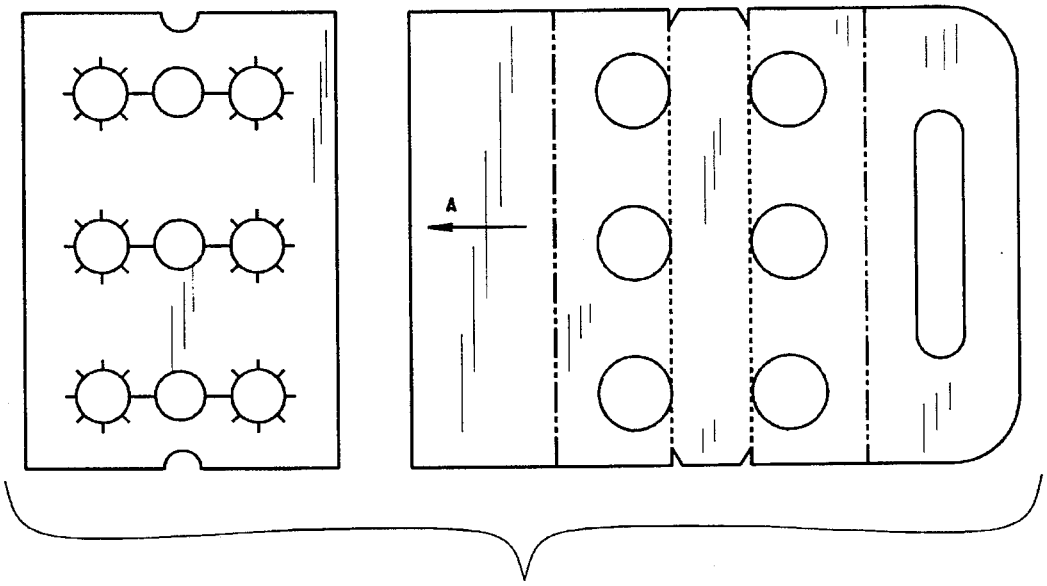
FIG. 11A is a plan view of a carrier blank used to form the carrier of FIG. 10A.
Figure 12A:
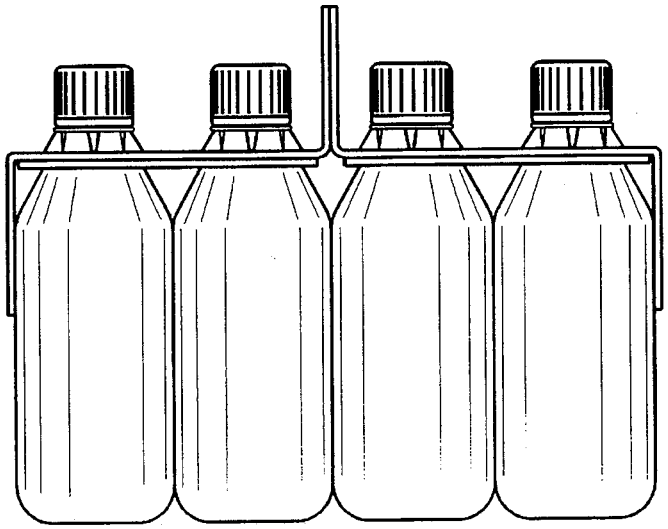
FIG. 12A is a side elevational view of a pair of the carriers of FIG. 10A secured together to form a dual-pack with a center handle.

As variations within the scope of the appended claims may be apparent to those skilled in the art, the foregoing description is set forth only for illustrative purposes and is not meant to be limiting. For example, although the carrier top is shown to have two plies, it could be made with three or more plies, if desired. These additional plies could be part of a one-piece, unitary blank, or could be separate pieces which are secured to the under lower plies. The openings 77 in the bottom panel 59 of the box top carriers were shown to be circular to encompass a single bottle or oval to encompass two bottles when formed. The opening 77 could also be made as a smaller oval which would encompass only one bottle, but would reduce the size of the paperboard area separating the two rows of bottles. Although not shown in the drawings, it will be apparent that the release mechanism could be applied to the carrier of FIGS. 1–11. Although not shown, it will be apparent that the box-top carriers could be provided with a front panel similar to the front panel 36 of FIG. 8B. The blanks were described to be formed into carriers by gluing or bonding the various panels together. It will be apparent that any conventional manner of securing the panels together may be used. The panels and pull tabs may be used for promotional coupons. The carriers of FIGS. 10 and 12 could be formed with a two-part top panel in a manner similar to the box-top carrier of FIG. 21, as shown in FIGS. 10A–C. To do this portion 43 and hinge 47 of carrier blank 20*c* (FIG. 11) would be eliminated and the portion 21*c*, which forms the second ply of the top panel, would be a separate piece. This would provide a carrier with a single ply handle rather than a two-ply handle, and thus would reduce the amount of material in the carrier. These examples are merely illustrative.

We claim:

1. A carrier for holding a plurality of bottles; the bottles each having a body, a neck extending upwardly from the body, a mouth at a top of said neck, a closure closing said mouth, and a flange adjacent said mouth, said flange having a lower surface defining a chime at a point where said flange and said neck intersect; said carrier including a top panel and at least one side panel; said top panel including:

a first ply defining an array of surrounding apertures;

a second ply below said first ply, said second ply defining an array of container receiving apertures and having a plurality of slits extending radially from each of said container receiving apertures to define tabs; and release openings positioned between adjacent container receiving apertures and;

a release mechanism for releasing said bottles from said carrier;

said surrounding apertures of said first ply having a diameter substantially equal to the diameter of a circle defined by outer ends of said slits, said surrounding apertures defining fold points for said tabs;

said container receiving apertures having a diameter slightly smaller than the diameter of said bottle chime such that when a bottle is urged through said container receiving apertures, said tabs are urged upwardly;

said release mechanism opening said surrounding apertures and effectively exposing said release openings when operated.

2. The carrier of claim 1 wherein said tabs have a length such that said tabs engage said bottle, the tabs having a width of between 0.25" and 0.35" at a tip of the tabs.

3. The carrier of claim 2 wherein said tabs forming an angle of between about 50° and about 70° with the top panel of the carrier.

4. The carrier of claim 2 wherein said tabs form an angle of about 60° with the top panel of the carrier.

5. The carrier of claim 3 wherein said tabs engage said bottle chime when said carrier is applied to the bottle.

6. The carrier of claim 1 wherein said carrier is formed from a one-piece, integral blank.

7. The carrier of claim 1 including two side panels, said side panels being hingedly connected to opposite edges of said first ply.

8. The carrier of claim 1 including a front panel depending from said top panel and extending between said side panels.

9. The carrier of claim 1 including a handle.

10. The carrier of claim 9 wherein said handle is positioned at a first edge of said top panel, said side panel being hingedly connected to said top panel at a second edge thereof, said first and second edges of said top panel being opposite each other.

11. The carrier of claim 10 including two such carriers, said carriers being connected together at least along their handles to form a dual pack carrier.

12. The carrier of claim 1 wherein said carrier defines a sleeve, said carrier including two side panels and a bottom panel, said bottom panel having continuous, uninterrupted edges extending between said side panels; said bottom panel defining an array of openings, said openings being substantially aligned with said container receiving apertures and said surrounding apertures in said top panel and having a diameter slightly smaller than the neck of said bottle along a plane where said bottom panel intersects a bottle neck when a bottle is inserted in said carrier; said side panels being sized to maintain said bottom panel in tension when said carrier has bottles therein, such that said bottom panel becomes upwardly arched; the openings in said bottom panel and the apertures in said top panel being positioned such that bodies of said bottles are substantially adjacent each other when placed in said carrier; at least a portion of an outer edge of said bottom panel openings frictionally engaging said bottle necks to urge said bottles together to substantially prevent said bottles from moving relative to each other when bottles are received in said carrier, the urging of said bottles together being strengthened when said carrier is lifted.

13. The carrier of claim 12 wherein said side panels are of a length that a downward arc is induced in said top panel when said bottles are placed in said carrier.

14. The carrier of claim 12 wherein the openings in the bottom panel are circular, there being one opening per bottle.

15. The carrier of claim 14 wherein when bottles are placed in the carrier, and the carrier is lifted, a gap is formed between a surface of said bottle and an inner edge of said circular opening.

16. The carrier of claim 12 wherein the openings in the bottom panel are elongate and have semi-circular ends; each opening encompassing two bottles.

17. The carrier of claim 12 wherein the first ply of the carrier is formed in two halves.

18. The carrier of claim 17 wherein said halves are hingedly connected to opposite side panels, said second ply of said top panel being independent and separate from said top, side, or bottom panels of said carrier.

19. The carrier of claim 17 including a handle, said apertures of said top panel defining two columns of apertures, said handle being located between the two columns of apertures, said handle having a first portion hingedly connected to a first half of said first ply and a second portion hingedly connected to a second half of said first ply, said first and second portions of said handle being substantially identical.

20. The carrier of claim 17 including a handle formed of two portions and wherein a first half of said top panel first ply is hingedly connected to a side panel of said carrier, a first portion of said handle being connected to said first half of said first ply, a second portion of said handle being hingedly connected to said handle first portion, and a second half of said first ply being hingedly connected to said handle second portion.

21. The carrier of claim 20 wherein one of said two handle portions defines a cut-out sized to permit a consumer's fingers to pass therethrough, the other of said two handle portions defining a flap which is aligned with said handle cut-out and adapted to be folded through said cut-out to define a protective surface of said handle.

22. The carrier of claim 12 including a handle, said handle having a portion hingedly connected to an edge of said top panel first ply to be positioned at an edge of said carrier; said handle including a first ply and a second ply, said handle second ply being hingedly connected to said handle first ply, said handle second ply having a length longer than said handle first ply to extend at least partially along a side panel of said carrier.

23. The carrier of claim 1 wherein said surrounding apertures and container receiving apertures each define two columns of apertures, said release mechanism including a release tab and release openings; said release tab being positioned between the two columns of said surrounding apertures of said first ply of said carrier top such that said release tab defines at least a portion of said surrounding aperture; said release openings being positioned between the two columns of said container receiving apertures in said second ply of said carrier top panel.

24. The carrier of claim 23 wherein said release tab includes a release tab leader and a release tab body, said release tab leader extending from an edge of said first ply to a point adjacent said surrounding aperture, said release tab body having a width at least as wide as a width between said surrounding apertures.

25. The carrier of claim 23 wherein said release openings define slits extending between said container receiving apertures.

26. The carrier of claim 23 wherein said release openings include a cut-out between said container receiving apertures and a slit extending from said release cut-out to an edge of said container receiving aperture.

27. The carrier of claim 26 wherein said release cut-out is elliptical.

28. The carrier of claim 12 wherein said release mechanism includes an individual release tab for each bottle which may be inserted in said carrier; each said release tab including a tear strip extending along the side panel, between an individual one of said apertures of said top panel to an associated opening on the bottom panel; and a finger grip operatively connected to said tear strip; wherein when said release tab is pulled, said release mechanism opens a selected aperture of said top panel, and its associated bottom panel opening, and forms an opening along a side of said carrier.

29. The carrier of claim 28 wherein said finger grip is formed in said first ply of said top panel.

30. The carrier of claim 28 wherein said finger grip is formed in said second ply of said top panel.

31. The carrier of claim 28 wherein said tear strip has a shape corresponding substantially to a shape of said bottle neck.

32. The carrier of claim 12 wherein said release mechanism includes at least a perforated line in said first and second plies of said top panel which when separated, allow for a bottle to be extracted from said carrier at a corner of the carrier.

33. The carrier of claim 32 wherein said release mechanism includes a perforated line and a slit extending from each said surrounding aperture in said first ply and a perforated line and a slit extending from each container receiving aperture in said second ply, said perforated line and slit of said first ply being at an angle to each other and extending from said surrounding aperture to adjacent edges of said carrier; said perforated line and slit of said second ply being aligned with the perforated line and slit of the first ply, such that when a corner area of the carrier is pushed or pulled against, a section of the corner will tear and hinge away from the container to open the apertures of the top panel.

34. A carrier for holding a plurality of bottles in at least two columns; the bottles each having a body, a neck extending upwardly from the body, a mouth at a top of the neck, a closure closing said mouth, and a flange adjacent said mouth, said flange having a lower surface defining a chime at a point where said flange and said neck intersect; said carrier including a top panel and at least one side panel; said top panel including:

a first ply defining a first array of surrounding apertures, and a second ply defining a second array of container receiving apertures, said apertures of said first and second arrays being concentric with each other;

one of said first and second plies having a plurality of slits extending radially from said apertures, said slits defining bottle retaining tabs which engage said bottle when bottles are inserted in said carrier to retain said bottles in said carrier; and a release mechanism for facilitating the removal of bottles from said carrier; said release mechanism including:

a release tab extending between said surrounding apertures of said first ply of said carrier top, said release tab including a release tab leader and a release tab body, said release tab leader extending from an edge of said first ply to a point adjacent said surrounding aperture, said release tab body having a width at least as great as a width between said surrounding apertures, such that said release tab defines at least a portion of said surrounding aperture; and release openings between adjacent container receiving apertures in said, second array of apertures in said second ply of said carrier top panel, said release openings being positioned between a first and second column of said apertures.

35. The carrier of claim 34 wherein said release openings define slits extending between said container receiving apertures.

36. The carrier of claim 34 wherein said release openings include a cut-out between said container receiving apertures and a slit extending from said release cut-out to an edge of said container receiving apertures.

37. The carrier of claim 36 wherein said release cut-out is elliptical.

38. A carrier for holding and transporting a plurality of long-necked, flanged bottles; said bottles each including a bottle body, a neck extending upwardly from said bottle body, a mouth at a top of the neck, a closure closing said mouth, and a flange adjacent said mouth, said flange having a lower surface defining a chime at a point where said flange lower surface intersects said neck; said carrier being generally quadrilateral in vertical cross-section; said carrier including:

a top panel, a bottom panel, and two side panels, said panels being operatively connected to define a sleeve;

said top panel having at least a top ply and a second ply; said top ply defining a plurality of surrounding apertures through which said bottle necks extend, said second ply defining a plurality of container receiving apertures formed concentrically with and having a diameter smaller than said surrounding apertures of said top ply, said second ply including a plurality of slits extending radially from said container receiving aperture to define a plurality of tabs;

said bottom panel having continuous and uninterrupted edges extending between said side panels; said bottom panel defining a plurality of openings concentric with said apertures in said top panel, said bottom panel being spaced from said top panel, said openings having an edge which frictionally engages a surface of said bottles when bottles are placed in said carrier and which force increases when said carrier is lifted; said openings being spaced such that said bottle bodies are in firm contact with each other when said bottles are placed in said carrier;

said side panels having a height such that said top and bottom panels are placed in tension when said bottles are placed in said carrier such that an arc is induced in said top panel and said bottom panel when said bottles are inserted in said carrier, wherein when said carrier is attached to a group of bottles to define a package of bottles, the package of bottles is firmly bound together by the force of the arched panels; a contact between said bottles being reinforced when said carrier is lifted to substantially prevent said bottles from moving relative to each other when said carrier is moved during handling or transportation to substantially prevent damage of said bottles.

39. The carrier of claim 38 wherein said side panels are sized such that a downward arc is induced in said top panel when bottles are placed in said carrier.

40. The carrier of claim 38 wherein said carrier is formed from a blank, said blank being a one-piece unitary blank having portions which define at least said side panels, said bottom panel and said first ply of said top panel of said carrier; said portions being hingedly connected to each other along fold lines, said fold lines being defined by scores or embossments in said blank.

41. The carrier of claim 38 including a release mechanism, said release mechanism being operable to effectively open at least said apertures in said top panel of said carrier.

42. The carrier of claim 38 wherein said arc induced in said top panel is a downwardly arc and the arc induced in the bottom panel is an upwardly directed arc.

43. The carrier of claim 38 wherein said side panels are placed in compression when bottles are placed in said carrier.

* * * * *